US012496501B2

(12) United States Patent
Poirier

(10) Patent No.: US 12,496,501 B2
(45) Date of Patent: Dec. 16, 2025

(54) LIGHTWEIGHT GOLF BAG WITH A TOP CUFF ACTUATOR MECHANISM

(71) Applicant: Acushnet Company, Fairhaven, MA (US)

(72) Inventor: Brian R. Poirier, Portsmouth, RI (US)

(73) Assignee: Acushnet Company, Fairhaven, MA (US)

( * ) Notice: Subject to any disclaimer, the term of this patent is extended or adjusted under 35 U.S.C. 154(b) by 716 days.

(21) Appl. No.: 17/540,772

(22) Filed: Dec. 2, 2021

(65) Prior Publication Data

US 2023/0173353 A1 Jun. 8, 2023

(51) Int. Cl.
*A63B 55/00* (2015.01)
*A63B 55/57* (2015.01)

(52) U.S. Cl.
CPC ..... *A63B 55/404* (2015.10); *A63B 55/57* (2015.10)

(58) Field of Classification Search
CPC ..... A63B 55/57; A63B 55/404
USPC ..... 206/315.3
See application file for complete search history.

(56) References Cited

U.S. PATENT DOCUMENTS 2,016,967 A 10/1935 Komers
2,119,695 A 6/1938 Woodcock
5,154,377 A * 10/1992 Suk ..... A63B 55/57 206/315.7
5,397,084 A * 3/1995 Wang ..... A63B 55/53 206/315.7
5,497,964 A 3/1996 Hagiwara
6,296,116 B1 * 10/2001 Schmidt ..... A63B 55/57 206/315.3
2019/0001202 A1 * 1/2019 Martell ..... A63B 71/021

FOREIGN PATENT DOCUMENTS

JP 09187541 A * 7/1997

OTHER PUBLICATIONS

European Search Report for EP Application No. 22208524.3 mailed Apr. 11, 2023 (10 pages).

* cited by examiner

*Primary Examiner* — Nathan J Jenness
*Assistant Examiner* — Jessica Kavini Tamil

(57) ABSTRACT

An example golf bag including a top cuff including a circular recess in an exterior surface of the top cuff, the circular recess including a through hole, wherein the top cuff has a top cuff hand width ($W_{TC\text{-}HAND}$) greater than 75 mm. The golf bag may also include a knuckle including an interior knuckle boss at least partially housed inside the circular recess, the knuckle boss including a through hole aligned with the through hole of the circular recess; and a leg-receiving portion. The golf bag may further include a leg connected to the leg receiving portion of the knuckle; a fastener extending through the through hole of the knuckle boss and the through hole of the circular recess; and an actuator handle coupled to the top cuff and in contact with the knuckle, wherein downward pressure applied to the actuator handle causes the knuckle to rotate about the fastener, wherein rotation of the knuckle causes the leg to deploy into an expanded state.

18 Claims, 24 Drawing Sheets

LIGHTWEIGHT GOLF BAG WITH A TOP CUFF ACTUATOR MECHANISM

INTRODUCTION

During a round of golf, a golfer is generally provided with several options for how to transport his or her golf clubs in a golf bag. For example, a golfer may choose to take a motorized cart or a push cart. In other cases, the golfer may choose to carry his or her bag for the round of golf. Due to the length and duration of a round of golf, carrying a golf bag with a full set of golf clubs can be a strenuous task that fatigues the golfer as the round progresses. The rate of fatigue increases as the weight of the equipment being carried, including the golf bag, increases.

It is with respect to these and other general considerations that the aspects disclosed herein have been made. Also, although relatively specific problems may be discussed, it should be understood that the examples should not be limited to solving the specific problems identified in the background or elsewhere in this disclosure.

SUMMARY

Examples of the present disclosure and technology describe improved golf bags. In an aspect, the present technology relates to a golf bag including a top cuff including a circular recess in an exterior surface of the top cuff, the circular recess including a through hole, wherein the top cuff has a top cuff hand width ($W_{TC\text{-}HAND}$) greater than 75 mm. The golf bag also includes a knuckle including an interior knuckle boss at least partially housed inside the circular recess, the knuckle boss including a through hole aligned with the through hole of the circular recess; and a leg-receiving portion. The golf bag further includes a leg connected to the leg receiving portion of the knuckle; a fastener extending through the through hole of the knuckle boss and the through hole of the circular recess; and an actuator handle coupled to the top cuff and in contact with the knuckle, wherein downward pressure applied to the actuator handle causes the knuckle to rotate about the fastener, wherein rotation of the knuckle causes the leg to deploy into an expanded state.

In an example, the top cuff further includes a first handle-receiving boss protruding inward from an interior surface of the top cuff and a second handle-receiving boss protruding inward from the interior surface of the top cuff, wherein the top cuff hand width ($W_{TC\text{-}HAND}$) is measured from an interior surface of the first handle-receiving boss to an interior surface of the second handle-receiving boss. In another example, the first handle-receiving boss includes a slot; and the actuator has an extension with a through hole, wherein the extension is positioned in the slot of the first handle-receiving boss and the fastener passes through the through hole of the extension. In yet another example, the knuckle defines a knuckle length axis, the leg-receiving portion defines a leg-receiving axis, and a leg retention angle is formed between the knuckle length axis and the leg-receiving axis, wherein the leg-receiving portion biases the leg towards an interior of the golf bag. In a further example, the leg retention angle is between 2 and 5 degrees.

In another example, the golf bag further includes a molded foot having an angled front portion, wherein the angled front portion has a foot angle ($A_F$) between 30-50 degrees. In yet another example, the golf bag further includes a floating hip pad, wherein the floating hip includes a first portion protruding outwardly from a body of the golf bag and a second portion extending substantially parallel to the body of the golf bag, wherein the second portion covers a portion of the leg when the leg is in a collapsed position. In still another example, the golf bag further includes a structured-pocket hip pad comprising a structured leg-facing side to stand the exterior surface of the structured-pocket hip pad off of a body of the golf bag by a distance greater than a thickness of the leg.

In another aspect, the technology relates to a golf bag that includes a top cuff having a front side, a back side, a player side, and a non-player side. The top cuff includes a first circular recess on the player side, the first circular recess including a through hole; and a second circular recess on the non-player side, the second circular recess including a through hole. The golf bag further includes a first knuckle including a first interior knuckle boss at least partially housed inside the first circular recess, the first knuckle boss including a through hole aligned with the through hole of the first circular recess; and a first leg-receiving portion; and a second knuckle including a second interior knuckle boss at least partially housed inside the second circular recess, the second knuckle boss including a through hole aligned with the through hole of the second circular recess; a second leg-receiving portion. The golf bag further includes a first leg connected to the first leg receiving portion of the first knuckle; a second leg connected to the second leg receiving portion of the second knuckle; a first fastener extending through the through hole of the first knuckle boss and the through hole of the first circular recess; a second fastener extending through the through hole of the second knuckle boss and the through hole of the second circular recess; an actuator handle coupled to the top cuff and in contact with the first knuckle and the second knuckle, wherein downward pressure applied to the actuator handle causes the first knuckle to rotate about the first fastener and the second knuckle to rotate about the second fastener, wherein rotation of the first knuckle and the second knuckle cause the first leg and the second leg to deploy into an expanded state; a first stay rod connected to the top cuff; and a molded foot connected to the stay rod.

In an example, the golf bag further includes a second stay rod connected to the top cuff and the molded foot, wherein the second stay rod has a non-circular cross section. In another example, the top cuff further includes a first spring rest on an exterior of the player side; a second spring rest on an exterior of the non-player side; and the golf bag further includes a first torsion spring having a first coil and two spring legs, wherein the first coil and one of the spring legs of the first torsion spring is at least partially housed within the first knuckle and the other spring leg is at least partially housed within the first spring rest, wherein the first fastener passes through a though hole of the first coil; and a second torsion spring having a second coil two spring legs, wherein the second coil and one of the spring legs of the second torsion spring is at least partially housed within the second knuckle and the other spring leg is at least partially housed within the second spring rest, wherein the second fastener passes through a though hole of the first coil. In still another example, the top cuff further includes a first handle-receiving boss protruding inward from an interior surface of the player side, the first handle-receiving boss including a first slot; a second handle-receiving boss protruding inward from an interior surface of the non-player side, the second handle-receiving boss including a second slot; and the actuator handle further includes a first extension with a through hole, wherein the first extension is positioned in the first slot of the first handle-receiving boss and the first fastener passes through the through hole of the first extension; and a second extension with a through hole, wherein the second extension is positioned in the second slot of the second handle-receiving boss and the second fastener passes through the through hole of the second extension. In yet another example, the foot is a molded foot having an angled front portion, wherein the angled front portion has a foot angle (AF) between 30-50 degrees.

In another example, the golf bag further includes a floating hip pad, wherein the floating hip includes a first portion protruding outwardly from a body of the golf bag and a second portion extending substantially parallel to the body of the golf bag, wherein the second portion covers at least a portion of first leg. In still another example, the golf bag further includes a structured-pocket hip pad comprising a structured leg-facing side to stand an exterior surface of the structured-pocket hip pad off of a body of the golf bag by a distance greater than a thickness of the first leg. In yet another example, the first knuckle defines a knuckle length axis, the first leg-receiving portion defines a leg-receiving axis, and a leg retention angle is formed between the knuckle length axis and the leg-receiving axis, wherein the leg-receiving axis biases the first leg towards an interior of the golf bag. In a further example, the leg retention angle is between 2 and 5 degrees. In still yet another example, the top cuff further comprises a shelf extending from the back side of the top cuff, wherein a top surface of the shelf provides a stop for the actuator handle when that actuator handle is rotated, and an underside of the shelf provides a position for a player's fingers to be placed when pressing the actuator handle to deploy the legs.

In another aspect, the technology relates to a golf bag that includes a top cuff including a circular recess in an exterior surface; and a knuckle including: an interior knuckle boss at least partially housed inside the recess; and a leg-receiving portion. The golf bag further includes a leg connected to the leg receiving portion of the knuckle, wherein the leg extends at a leg angle (ALEG) between 10-25 degrees; an actuator handle coupled to the top cuff and in contact with the knuckle, wherein downward pressure applied to the actuator handle causes the knuckle to rotate, wherein rotation of the knuckle causes the leg to deploy into an expanded state from a collapsed state; and at least one of: a floating hip pad, wherein the floating hip includes a first portion protruding outwardly from a body of the golf bag and a second portion extending substantially parallel to the body of the golf bag, wherein the second portion covers at least a portion of the leg when the leg is in the collapsed position; or a structured-pocket hip pad comprising a structured leg-facing side to stand the exterior surface of the structured-pocket hip pad off of a body of the golf bag by a distance greater than a thickness of the leg. In an example, the floating hip pad further comprises a wedge spacer.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Additional aspects, features, and/or advantages of examples will be set forth in part in the description which follows and, in part, will be apparent from the description, or may be learned by practice of the disclosure.

BRIEF DESCRIPTION OF THE DRAWINGS

Non-limiting and non-exhaustive examples are described with reference to the following figures.

DETAILED DESCRIPTION

As discussed above, the weight of golf equipment being carried a golfer has an effect on the fatigue of a golfer as the golf equipment is carried by the golfer. To help reduce the overall weight of the golf equipment carried by the golfer, the present technology looks reduces the mass of the bag. As one improvement, the present golf bag is a stand bag that allows for legs to extend from the golf bag so that the entire bag does not need to touch the ground. In many stand bags, the actuator for leg extension is on the bottom of the bag and actuates the leg extension when the bottom of the bag is placed on the ground. The present technology, however, uses a hand actuator at the top of the bag to actuate the leg extension. By utilizing a hand actuator rather than the bottom actuator, additional weight savings may be achieved due to the comparative components required. The hand-actuation system also utilizes an ergonomic configuration to provide a more effective and more-easily actuated system. Additional improvements have been made to provide other improvements for stability, durability, storage capacity, and usability while utilizing light-weight components, such as molded components.

Figure 1:
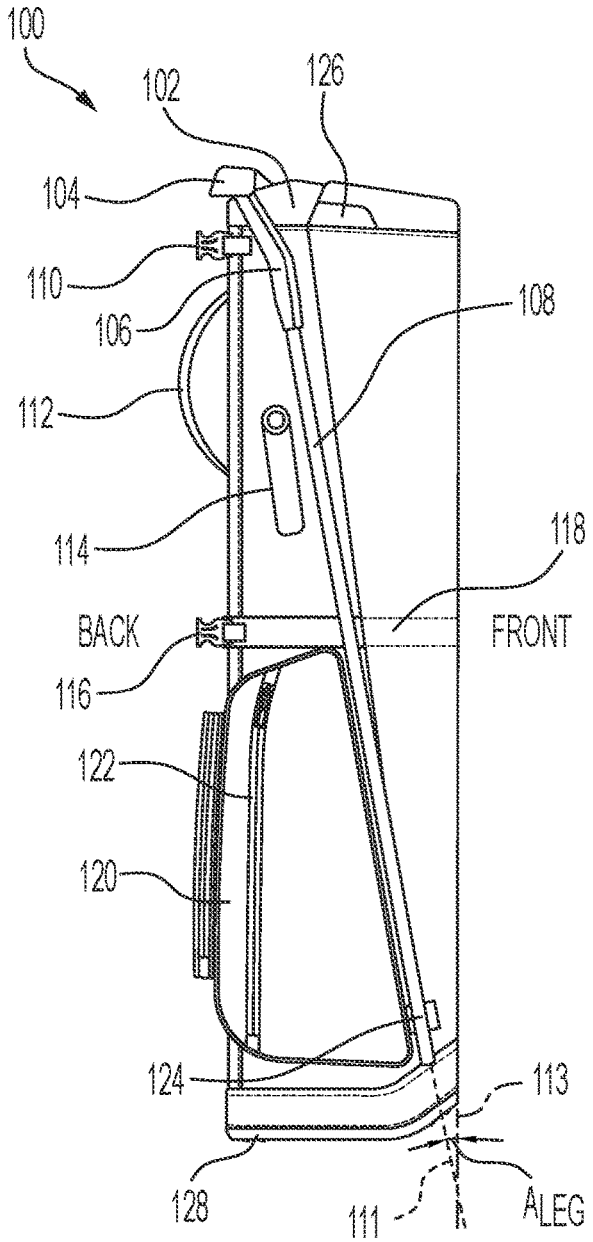
FIG. 1 depicts a right side view of an example golf bag.
Figure 2:
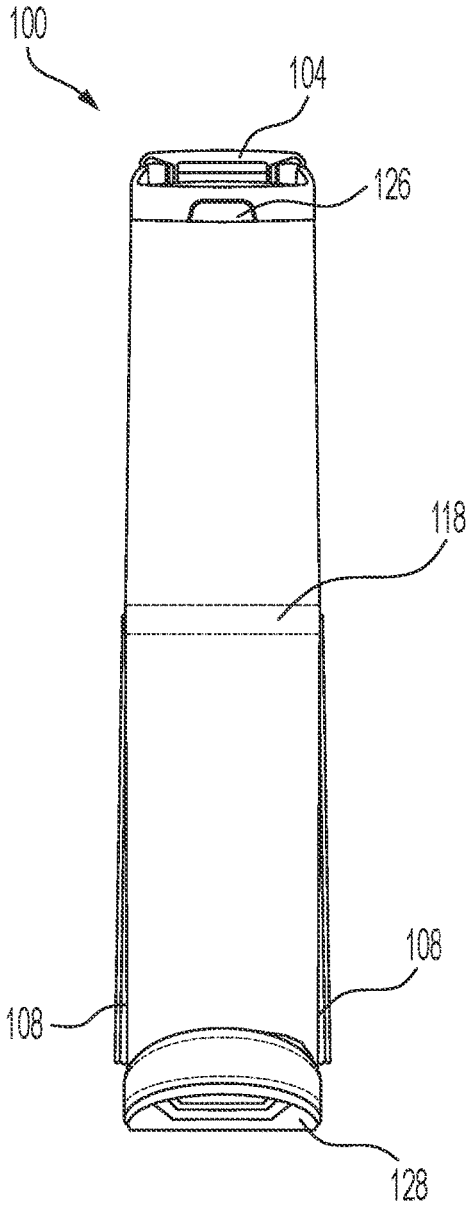
FIG. 2 depicts a front view of the example golf bag of FIG. 1

FIG. 1 depicts a right side view of an example golf bag 100, and FIG. 2 depicts a front view of the example golf bag 100 of FIG. 1. The reference frame of the right side is as viewed from the back of the golf bag 100. The right side may also be referred to as the non-player side as compared to the left side of the bag 100, which may be referred to as the player side of the bag 100. The player side of the bag 100 is the side of the bag that is intended to be in contact with the player when the bag 100 is being carried by the player.

The golf bag 100 includes a top cuff 102 at the top of the golf bag 100. The top cuff 102 may be a molded component that provides rigidity at the top of the golf bag 100. An actuator handle 104 is attached to the top cuff 102. The actuator handle 104 is in contact with two knuckles 106 that are attached to legs 108. The actuator handle 104 may be in contact with a first knuckle 106 on the player side of the golf bag 100 and a second knuckle 106 on the non-player side of the golf bag 100. Each of the knuckles 106 is attached to a leg 108. When the actuator handle 104 is actuated (e.g., pressed down) by a player's hand, the legs 108 extend outwards from the front of the bag 100 to a splayed or extended position. For instance, the actuator handle 104 presses down on the knuckles 106, which causes the knuckles 106 to rotate. The rotation of the knuckles 106 causes the legs 108 to deploy outward to the expanded state. The bag 100 may then be set on the ground, and the bag is supported by the bottom of the bag 100 and the two legs 108 in the expanded or splayed position.

The knuckle 106 and the leg 108 extend, from a back portion of the top cuff 102, downwards and towards the front portion of the bottom of the bag 100. For instance, the top portion of the knuckle 106 may begin at a back ¼ or back ⅙ of the top cuff 102 and the end of the leg 108 may be located in the front quarter of the bag 100 when the legs 108 are in the collapsed position. The legs 108 extend along the player side and the non-player side of the bag 100, which is in contrast to other golf bags where the legs are located on the front of the golf bag rather than the sides.

Each leg 108 may define a leg axis 111 that is the axis running through the length of the leg 108. The bag 100 may also define a bag axis 113. The bag axis 113 may be the axis running through the length of the bag 100. When the bag is stood upright, as shown in FIG. 1, the bag axis is a vertical axis orthogonal to a plane defined by the ground, e.g., the ground plane. A leg angle ($A_{LEG}$) is formed between the leg axis 111 and the bag axis 113. In some examples, the leg angle ($A_{LEG}$) may be between 10-25 degrees.

The outside of the top cuff 102 may also include one or more hood-attachment components 126. The hood-attachment component 126 may a be button, hook-and-loop pad, or other attachment device for attaching a hood to cover clubs that are stored in the bag 100.

The golf bag 100 also includes first clip set or clip 110 and a second clip set or clip 116 for connecting a shoulder strap assembly (not shown). The should strap assembly may include one or two shoulder straps that are worn by the player while carrying the golf bag 100. One end of the shoulder strap assembly may attach to the first clip 110, and a second end of the should strap assembly may attach to the second clip 116. In other examples, the clips 110, 116 may be other attachment mechanisms such as loops, ties, or other types of attachment mechanisms. Internal webbing 118 may also be provided at the position of the second clip 116 to provide additional support for bag 100 when being carried by the shoulder strap assembly.

A player handle 112 is also attached to the spine on the backside of the golf bag 100. The player handle 112 allows for the player to pick up the golf bag 100 to carry the bag potentially with one hand. The upper portion of the non-player side of the golf bag 100 may also include a pen garage 114 that can house a pen or marker used for scorekeeping or marking of golf balls. The pen garage 114 includes an opening and a sleeve to receive the body of the pen or marker.

The non-player side of the golf bag 100 may also include a structured storage pocket 120. The structured storage pocket 120 may include a valuables pocket 122 on the outside or exterior of the pocket 120. The valuables pocket 122 may be lined with a soft liner, such as velour, to allow for valuables to be stored without being damaged or scratched. The structured storage pocket 120 includes a reinforced portion that offsets the structured storage pocket 120 from the body of the golf bag 100. For instance, the surface of the structured storage pocket 120 facing and contacting the leg 108 may be formed from a structured material, such as a stiffened board, to provide structure for the structured storage pocket 120.

The structured material and structured side of the structured storage pocket 120 also provides for a landing zone for the leg 108. For instance, when the leg 108 is in the collapsed position (as shown in FIG. 1), the leg 108 may be in contact the structured storage pocket 120. The structured side of the structured storage pocket 120 provides a stop of the leg 108 to better secure the leg 108 in the collapsed position. In addition, the structured portion helps prevent the structured storage pocket 120 from overlapping the leg 108, even when the structured storage pocket 120 may be over-filled with items. Without the structured portion, the structured storage pocket 120 may droop further towards from the front of the bag when be carried. Such drooping of a non-structured pocket may overlap the leg 108 making it more difficult to actuate into the splayed position using the actuator handle 104. In other cases, the drooping of a non-structured pocket may prevent the leg from fulling closing or reaching a consistently closed position. The trapping or blocking of the leg 108 may damage the leg of the other components attached thereto, such as the knuckle 106, the actuator handle 104, and/or the top cuff 102, among other components. A leg-retention loop 124, such as a hook-and-loop strap, may also be included to secure the leg 108 during travel.

A molded base or foot 128 is also included at the bottom of the bag 100. The foot 128 may be molded out of a stiff material than the fabric of the bag to provide a more rigid based for the bag 100 when the bag 100 is placed on the ground. In some examples, the foot 128 and the top cuff 102 may be molded from the same material. The front portion of the foot 128 is angled upwards to provide a more stable base for the bag 100 when the bag is in the expanded position. For instance, as the legs 108 are moved to their expanded position and the bag 100 is rotated forward to place the ends of the legs on the ground. When the bag 100 rotates forward to the expanded position, the front portion of the foot 128 lays flat on the ground.

Figure 3:
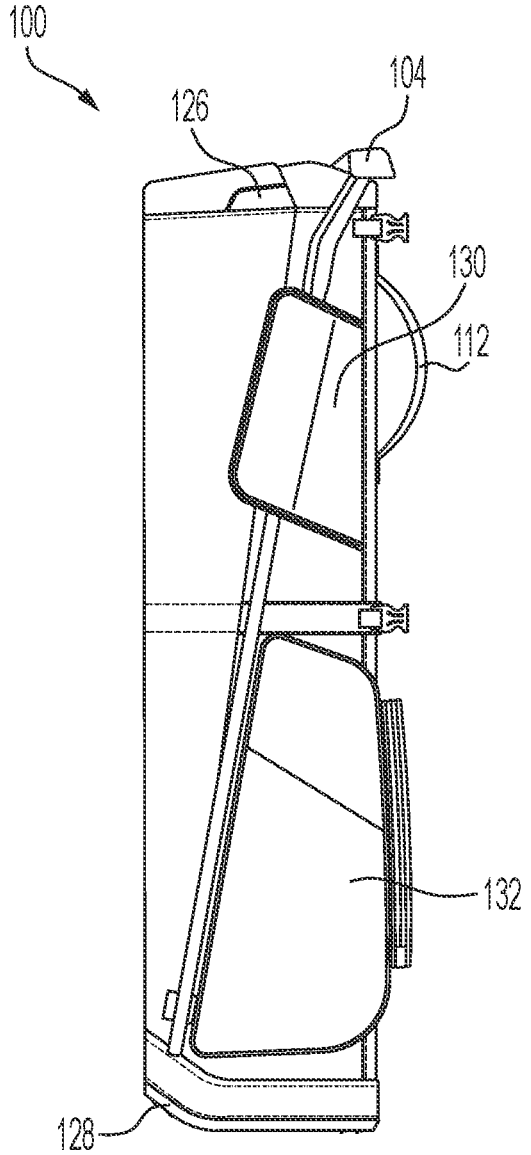
FIG. 3 depicts a left side view of the example golf bag of FIG. 1.
Figure 4:
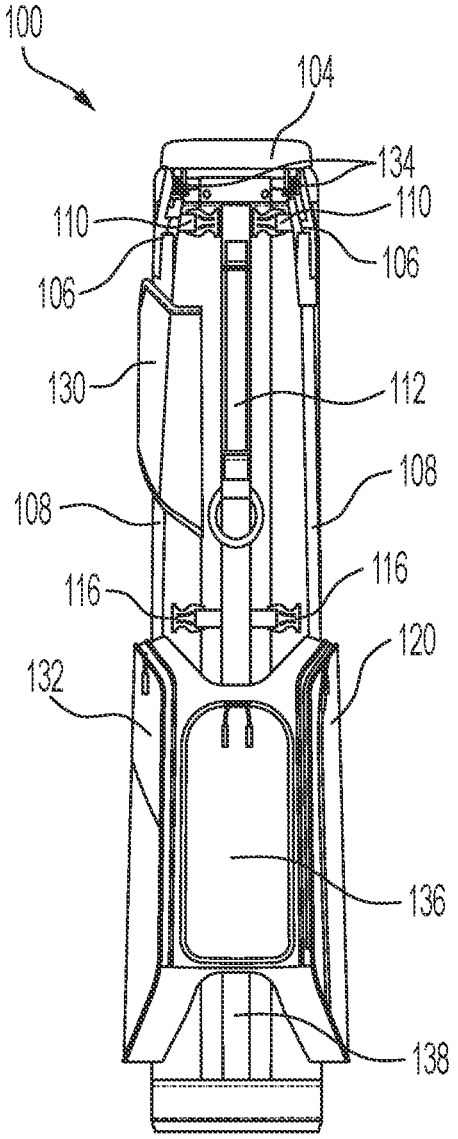
FIG. 4 depicts a back view of the example golf bag of FIG. 1.

FIG. 3 depicts a left, or player, side view of the example golf bag 100 of FIG. 1. FIG. 4 depicts a back view of the example golf bag 100 of FIG. 1. The player side of the golf bag 100 may include another structured pocket 132, which may be referred to as a player-side structured pocket 132. The player-side structured pocket 132 may share some similarities with the structured storage pocket 120. For instance, the side of the player-side structured pocket 132 in contact with, or facing, the leg 108 may be made from a more rigid or structured material to provide the same or similar benefits as the structured side of the structured storage pocket 120. For instance, the player-side structured pocket 132 may provide a landing zone for the leg 108, and therefore the structuring of the player-side structured pocket 132 prevents drooping that may interfere with the leg 108 opening or closing.

The player-side structured pocket 132, however, may differ from the structured storage pocket 120 in some ways. For instance, instead of including a valuables pocket 122 on the outside of the structured storage pocket 120, the player-side structured pocket 132 may include an insulated sleeve that may be used for storing beverages or other items where insulation is beneficial.

Because one of the legs 108 runs along the player side of the bag 100, the leg 108 has the opportunity to contact the player's back or hip while the player is carrying the bag 100. Having a leg 108 pressing against the player's back or hip would be uncomfortable. To help prevent the leg from contacting the player's back or hip, the bag 100 includes a floating hip pad 130.

The floating hip pad 130 is offset from the body of the example golf bag 100 by a distance that is greater than the thickness of the leg 108. For instance, a portion of the floating hip pad 130 extends outwardly from the bag 100, and a second cantilevered portion (that contacts the player when the bag is worn) extends substantially parallel to the body of the bag 100 and covers the leg 108 when the leg 108 is in the collapsed position. Thus, the portion of the leg 108 underneath the second portion of the floating hip pad 130 (e.g., the portion of the leg 108 between the floating hip pad 130 and the body of the bag 100) does not contact the player's body when the bag is worn by the player. That second portion of the floating hip pad 130 may also include padded material to provide additional comfort to the player. While only one floating hip pad 130 is depicted in FIGS. 3-4, in other examples, a floating hip pad 130 may be placed on the left and right sides of the bag 100 in case the player may choose to reconfigure the straps of the bag 100 such that bag is worn by the player on the opposite side. As such, the player's body would still be protected from the legs 108 on either side of the bag 100.

The bag 100 also includes a zippered pocket 136 on the back or spine of the bag 100. The pocket 136 may share one or more common exterior walls with the structured pocket 132 and/or the valuables pocket 122. The pocket 136 provides additional storage for the golf bag 100 while still resulting in a smaller, lightweight design of the golf bag 100. In some examples, the pocket 136 may be referred to as a ball pocket 136.

A webbing 138 may also be included to reinforce the spine of the golf bag 100. The webbing 138 may provide for a higher material strength along the spine of the golf bag 100. The higher material strength allows for greater durability due to wear and tear from use of the player handle 112 or shoulder straps attached to the first clip 110 and the second clip 116.

Figure 5:
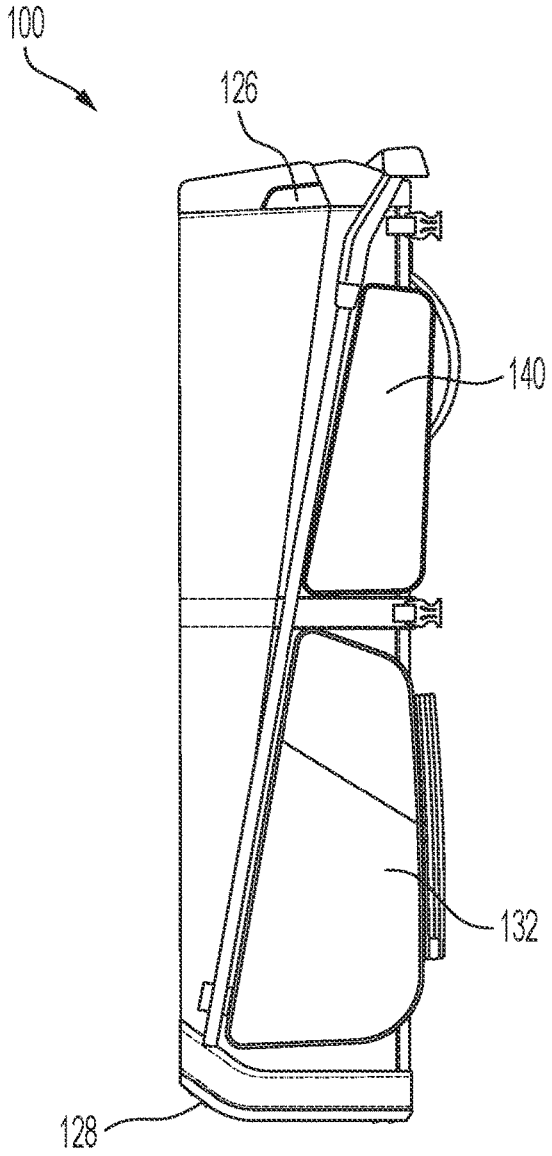
FIG. 5 depicts a left side view of a different configuration of the golf bag of FIG. 1.
Figure 6:
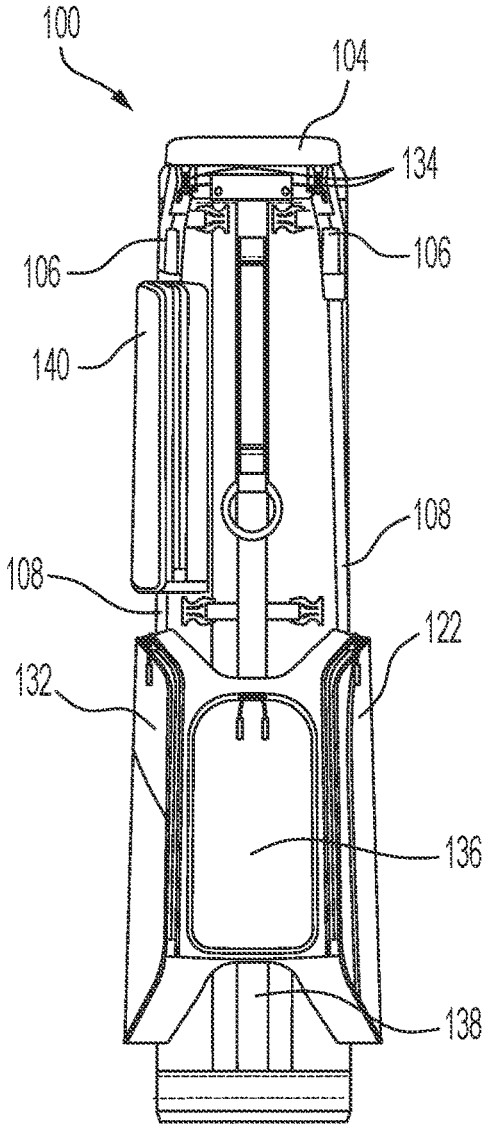
FIG. 6 depicts a back view of the different configuration of the golf bag of FIG. 5.

FIG. 5 depicts a left, or player, side view of a different configuration of the golf bag 100 of FIG. 1. FIG. 6 depicts a back view of the different configuration of the golf bag 100 of FIG. 5. The configuration in FIGS. 5-6 differs from the configuration in FIGS. 3-4 in that hip pad 130 is replaced by a structured-pocket hip pad 140.

The structured-pocket hip pad 140 may be similar to the structured pocket 132 in that the side of the structured-pocket hip pad 140 that faces, or is in contact with, the leg 108 is structured. For instance, the side of the structured-pocket hip pad 140 that faces the leg 108 may be made of a rigid material, such as a PE board, that causes the side to extend from, or stand off from, the side of the bag 100. The surface of the structured-pocket hip pad 140 facing the player's back is stood off from the outside surface of the bag 100 by an amount that is greater than the thickness of the leg 108. Thus, the structured-pocket hip pad 140 provides a pad or protection that helps prevent the leg 108 from contacting the body of the player while the bag 100 is worn or being carried by the player. The surface of the structured-pocket hip pad 140 that contacts the player's back or hip may also include padding to further increase the comfort of the player while the bag 100 is being carried.

In some examples, the cantilevered second portion of the floating hip pad 130 may be combined with the structured-pocket hip pad 140 such that an additional portion extends from the structured-pocket hip pad 140 to cover the leg 108 when the leg 108 is in the collapsed position. The structured-pocket hip pad 140 may also include a zippered pocket that allows for additional storage of items. While only one structured-pocket hip pad 140 is depicted in FIGS. 4-5, in other examples, a structured-pocket hip pad 140 may be placed on the left and right sides of the bag 100 in case the player may choose to reconfigure the straps of the bag 100 such that bag is worn by the player on the opposite side. As such, the player's body would be protected from the legs 108 on either side of the bag 100.

Figure 7:
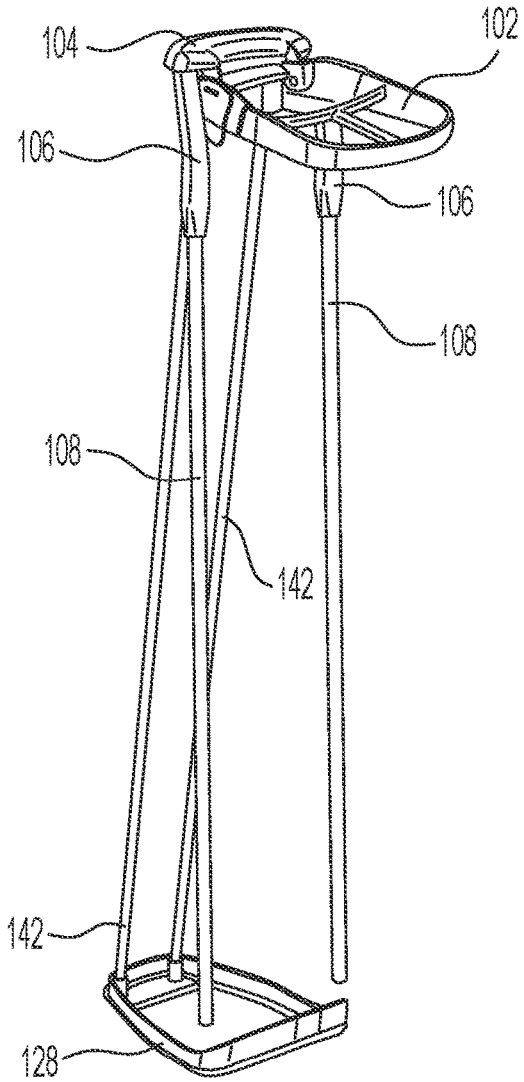
FIG. 7 depicts a perspective view of the skeleton of the golf bag.
Figure 8:
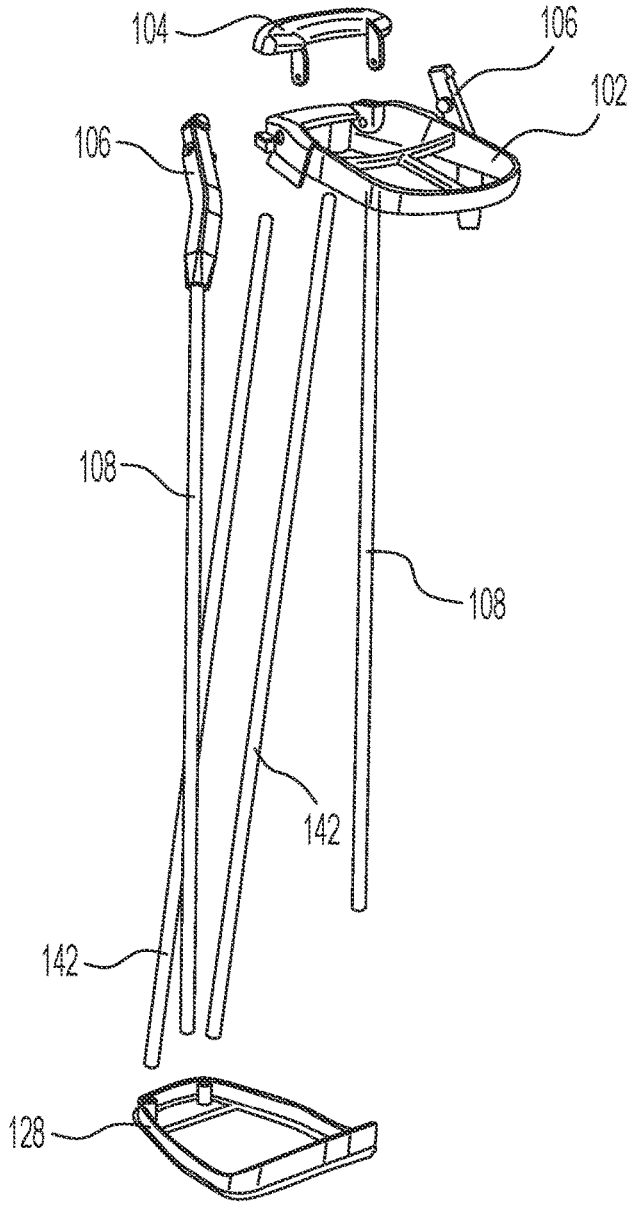
FIG. 8 depicts an exploded view of components of the skeleton.

FIG. 7 depicts a perspective view of the skeleton of the golf bag 100. FIG. 8 depicts an exploded view of components of the skeleton. The skeleton of the bag 100 includes structural components of the golf bag 100 that are not made of fabric. For instance, the skeleton includes the top cuff 102, the actuator handle 104, the knuckles 106, the legs 108 and the molded foot 128. The skeleton of the golf bag also includes one or more stay rods 142. The stay rods 142 are attached to the top cuff 102 and the molded foot 128 to provide lengthwise support and rigidity for the golf bag 100. In the example depicted, two stay rods 142 are implemented that are attached to the rear of the top cuff 102 and the rear of the foot 128. A first stay rod 142 is attached on the player side of the bag 100, and a second stay rod 142 is attached on the non-player side of the bag 100. In other examples, a single stay rod 142, however, may be implemented. The single stay rod 142 may be located at the rear of the golf bag 100 and substantially centered between the player side and the non-player side of the golf bag 100. The use of the two stay rods 142 helps prevent against twisting of the top cuff 102 relative to the foot 128, which improves the overall durability of the skeleton and the golf bag 100.

Figure 9:
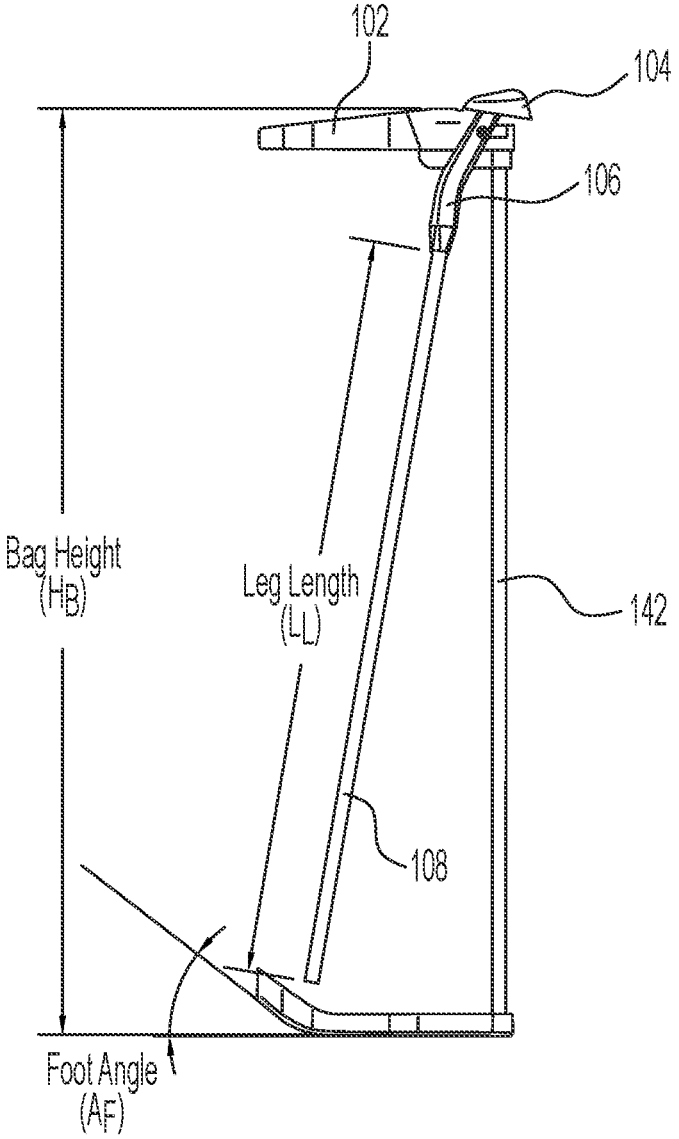
FIG. 9 depicts a side view of the skeleton.

FIG. 9 depicts a side view of the skeleton of the golf bag 100. As shown in FIG. 9, a bag height ($H_B$) may be measured from the top of the actuator handle 104 to the lowest point on the molded foot 128. In some examples, the bag height ($H_B$) may be between 850-950 mm. A leg length ($L_L$) may also be measured from the end of the knuckle 106 to the end of the leg 108. The leg length ($L_L$) may be between 650-700 mm. The leg length ($L_L$) may be based on the bag height and the leg angle ($A_{LEG}$). For instance, it may be undesirable to have the legs 108 extend beyond the body of the bag 100. In contrast, having legs 108 that are too short may cause the top of the bag to move to far towards the ground, making access to the clubs in the bag 100 more difficult. In some cases, the ratio of the bag height ($H_B$) to the leg length ($L_L$) may be between 1.2:1 and 1.4:1 to maintain a useful height of the bag 100 when in the expanded state.

As discussed above, the front portion of the foot 128 that is angled upwards. The angle at which the front portion of the foot 128 extends may be referred to as the foot angle ($A_F$). The foot angle ($A_F$) is measured between the ground plane and a plane formed or defined by the front angled portion of the foot 128. The foot angle may be between 30-50 degrees or between 35-45 degrees. The foot angle ($A_F$) may be based on the bag height ($H_B$) as well as the leg length ($L_L$). For example, the foot angle ($A_F$) may be configured such that when the bag 100 is in the expanded state, the front portion of the foot 128 is parallel to the ground. Accordingly, shorter leg lengths may result in a larger foot angle ($A_F$) as the top of the bag 100 tilts further forward with shorter legs. The angled portion of the foot 128 may be at least ⅕ or ⅙ the entire length of the foot 128.

Figure 11:
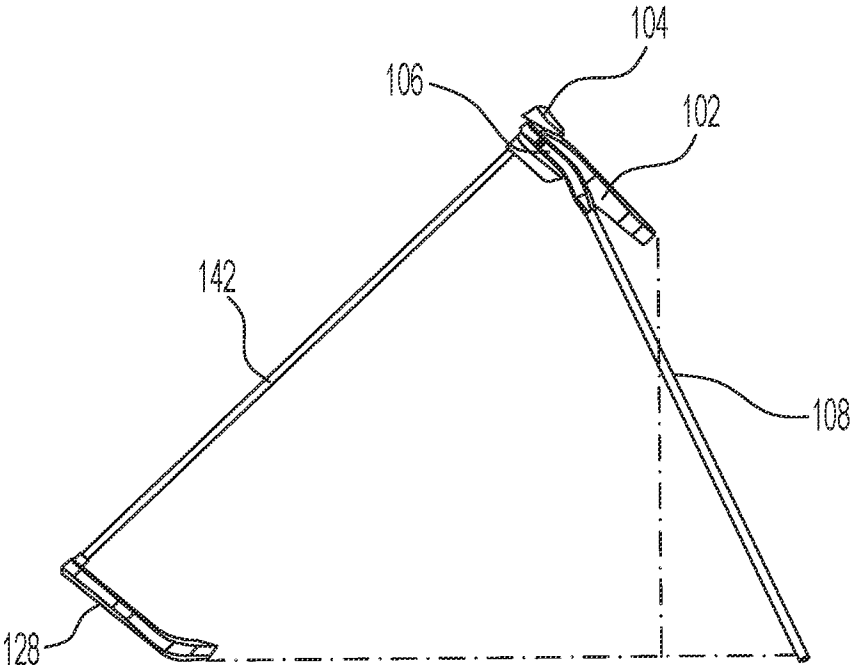
FIG. 11 depicts a side view of the skeleton in the expanded state.
Figure 10:
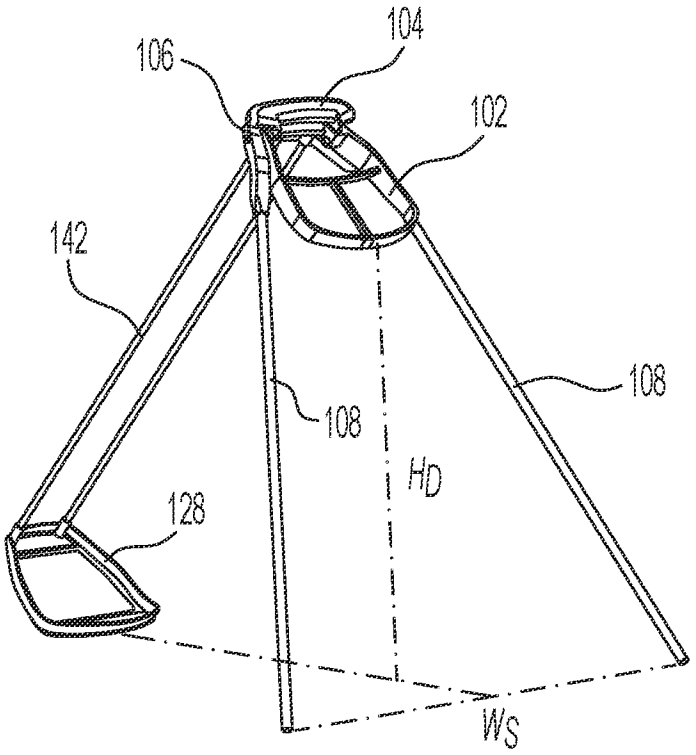
FIG. 10 depicts a perspective view of the skeleton in the expanded state.

FIG. 10 depicts a perspective view of the skeleton in the expanded state. FIG. 11 depicts a side view of the skeleton in the expanded state. When the actuator handle 104 is actuated to deploy the legs 108, the legs 108 and the foot 128 support the bag 100. When in the expanded state, the distance between the bottom of the legs 108 is referred to as the splay width ($W_S$). The splay width ($W_S$) may be important in providing stability to the bag 100 when in the expanded state. For instance, a splay width ($W_S$) that is too small may result in an unstable setup as the bag 100 may be prone to tipping either left or right. In contrast, a splay width that is too wide results in the legs 108 being obtrusive or occupying too large of an area. In some examples, the splay width ($W_S$) may be between 22-25 inches or between 22-24 inches.

The deployed height ($H_D$) may also be important to stability as a deployed height that is too high may lead to instability in the front-to-back direction, and a deployed height ($H_D$) that is too low may make the bag 100, or the golf clubs stored therein, difficult to access when in the deployed position. The deployed height ($H_D$) may be measured from the front of the top cuff 102 to the ground. In some examples, the deployed height ($H_D$) is between 22-25 inches or between 23-24 inches. Additional stability may result from having the splay width ($W_S$) be a similar distance as the deployed height ($H_D$). For example, the deployed height ($H_D$) may be within 10% of the of the splay width ($W_S$).

Figure 13:
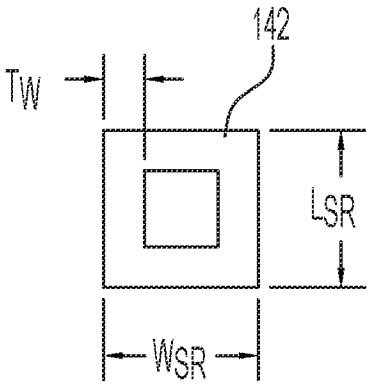
FIG. 13 depicts a cross section of one of the example stay rods.
Figure 12:
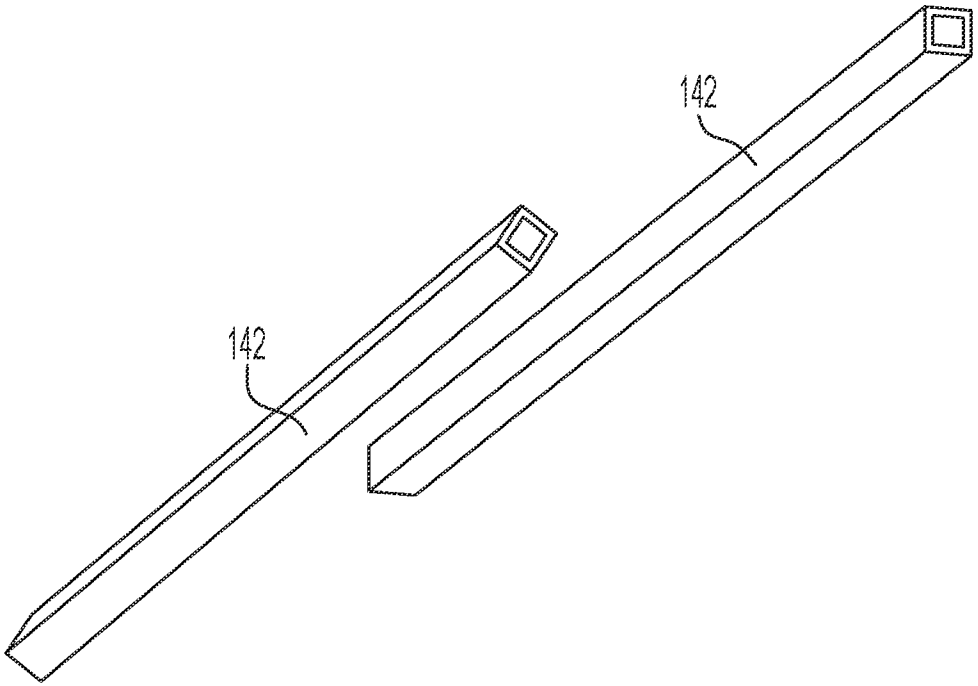
FIG. 12 depicts a perspective view of example stay rods.

FIG. 12 depicts a perspective view of example stay rods 142, and FIG. 13 depicts a cross section of one of the example stay rods 142. To continue to reduce weight of the golf bag 100, the stay rods 142 may be constructed from fiberglass reinforced plastic or carbon fiber. Such materials provide a light-weight solution with a suitable rigidity to support the bag 100. The rectangular or square cross-section of the stay rods 142 provides for additional improvements for the golf bag 100. For instance, by having a non-circular cross section, the rods 142 also help align the top cuff 102 with the foot 128 because the non-circular stay rods 142 prevent rotation of either the top cuff 102 or the foot 128 about one or more of the rods 142.

In some examples, the stay rods 142 may be hollow and have a wall thickness ($T_W$) between 2-4 mm. In some examples, the stay rods 142 may have a square cross section where the length of the cross section ($L_{SR}$) and the width of the cross section ($W_{SR}$) are the same. In such examples, the width may be between 6-10 mm. In other examples, the stay rods 142 have a rectangular cross section where the length of the cross section ($L_{SR}$) and the width of the cross section ($W_{SR}$) are different. In such examples, the width ($W_{SR}$) may be between 5-8 mm, and the length ($L_{SR}$) may be between 6-10 mm.

Figure 14:
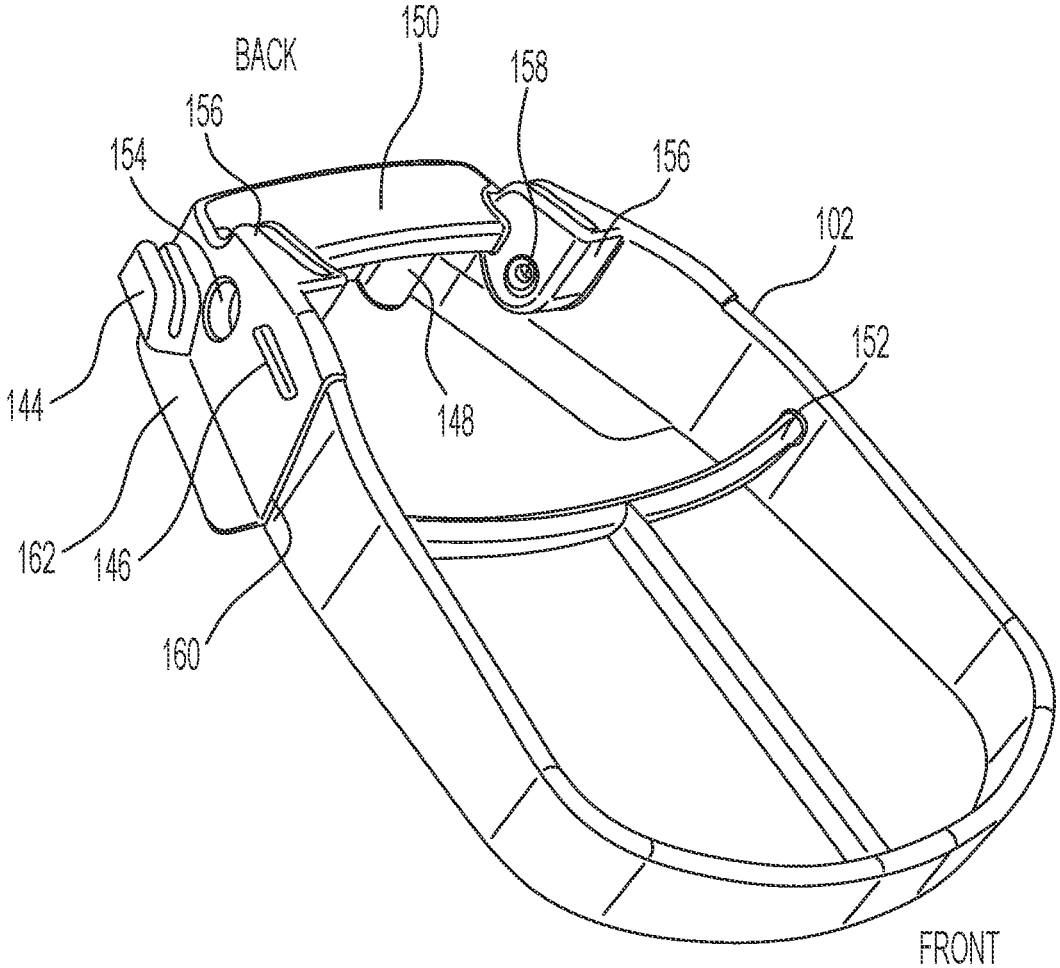
FIG. 14 depicts a perspective view of a portion of a top cuff of the golf bag.

FIG. 14 depicts a perspective view of a portion of a top cuff 102 of the golf bag 100. The top cuff 102 may be injection molded or formed as a single component, which further helps reduce weight and increase durability of the bag 100 as fewer fasteners or other attachment mechanisms need be incorporated. As an example, the top cuff 102 may be made from a polypropylene copolymer and/or a nylon material. Such materials allow for the top cuff to have a weight less than or equal to 0.5 pounds, 0.36 pounds, or 0.23 pounds.

The top cuff 102 includes a plurality of features and components that allow for additional components, such as the actuator handle 104 and the stay rods 142, to be attached to the top cuff 102. For example, the top cuff 102 may include two bosses with rod receiving recesses 148 that receive the stay rods 142. The top cuff 102 may also include a spring rest 144 that receives, or at least partially houses, a leg of torsion spring. The spring rest 144 protrudes from the exterior of the top cuff 102 and is located in the rear of the top cuff 102. The spring rest 144 includes a boss or protrusion of material that includes either a groove or hole to receive the leg of the torsion spring.

One spring rest 144 is included on the player side of the top cuff 102 and another spring rest 144 is included on the non-player side of the top cuff 102. Each spring rest 144 may be located in the rear quarter of the top cuff 102.

The top cuff 102 also includes a leg-stop tab 146. The leg-stop tab 146 protrudes outward from the exterior of the top cuff 102. The leg-stop tab may be an elongated protrusion of material on the exterior surface of the top cuff 102/The leg-stop tab 146 stops the knuckle 106 or leg 108 from rotating past the leg-stop tab 146. One leg-stop tab 146 is included on the player side of the top cuff 102, and another tab 146 is included on the non-player side of the top cuff 102. Each leg-stop tab 146 may be located in the rear third of the top cuff 102.

The top cuff 102 also includes a recess 154 for receiving, or at least partially housing, a boss of the knuckle 106. When the knuckle boss is inserted into the recess 154, the knuckle 106 may then rotate around knuckle boss. Thus, the recess 154 is configured to have a diameter similar to the knuckle boss 106 but still allow enough room for the knuckle boss to rotate freely in the recess 154. The recess 154 is recessed into the exterior of the top cuff 102.

The recess 154 also includes a though hole 158 for receiving a fastener, such as a screw, bolt, pin, or other fastening/shaft means that allows for rotation of the knuckle 106 around the fastener. The though hole 158 may be located in the center of the recess 154. The through hole 158 extends from the exterior surface of the recess 154 to the interior surface of the top cuff 102.

One recess 154 is included on the player side of the top cuff 102 and another recess 154 is included on the non-player side of the top cuff 102. Each recess 154 may be located in the rear quarter or third of the top cuff 102. For instance, the recess 154 may be located between the spring rest 144 and the tab 146.

The top cuff 102 also includes a handle-receiving boss 156 that includes a groove or slot for receiving extensions of the actuator handle 104. The handle-receiving boss 156 protrudes inward from the interior surface of the top cuff 102. The through hole 158 also extends through the handle-receiving boss 156 such that the fastener may be placed through the recess 154, the handle-receiving boss 156, and the extension of the actuator handle 104 when the actuator handle 104 is positioned in the handle-receiving boss 156. The handle-receiving boss 156 may be located at the same front-to-back location on the top cuff 102 as the recess 154.

The top cuff 102 also includes a shelf 150 on the rear of the of the top cuff 102. The top surface of the shelf 150 may provide a stop for the actuator handle 104 when that actuator handle 104 is pressed towards the shelf 150 during actuation. The underside of the shelf 150 also provides a position for the player's fingers to be placed when pressing the actuator handle 104 to deploy the legs 108. For instance, as the player reaches into the bag 100 via the top cuff 102, the player's fingers may be placed under the shelf 150 to provide leverage for pressing the actuator handle 104 down with the palm of the player's hand. The shelf 150 may protrude inward (e.g., towards the front edge of the top cuff 102) from the rear surface of the top cuff 102, and the shelf 150 may protrude inwardly by at least 0.5 inches. The shelf 150 may also extend from the player side boss 156 to the non-player side boss 156. The shelf 150 may also have a lip at the fort edge of the shelf that protrudes downward to provide an additional gripping surface or edge for the player's fingers. In addition to providing a surface to increase leverage for the player, the shelf 150 also provides additional structural support for the rear portion of the top cuff 102 to help prevent against twisting or torqueing issues when the bag 100 is in use.

The exterior surface of the top cuff 102 may also include a surface protrusion 160. The portion of the top cuff 102 forward of the surface protrusion 160 may be covered in a fabric or other textile, and the portion of the top cuff 102 to the rear of the surface protrusion 160 may be left uncovered. The fabric that wraps the front portion of the surface protrusion 160 has some thickness, and the thickness of the surface protrusion 160 may be based on the thickness of that fabric. Accordingly, once the front portion is covered in fabric, the outer surface of the fabric is substantially contiguous or flush with the rear exterior surface of the top cuff 102 to the rear of the surface protrusion 160. Therefore, there is a lower likelihood of the edge of the fabric being caught on another item when the bag 100 is in use, which improves the overall durability of the bag 100. In addition, bay having the rear portion of the top cuff 102 exposed rather than covered in fabric, the leg 108 and knuckle 106 are able to pivot more freely without interference from the fabric.

A three-way divider 152 may also be included as part of the top cuff 102. The three-way divider 152 includes a first cross bar that extends in a left-to-right direction and extends from the interior surfaces of the top cuff 102. The three-way divider 152 also includes a second cross bar that extends in the front-to-back direction and extends from the interior surface of the top cuff 102 to a front surface of the first cross bar. The three-way divider 152 allows for better organization, separation, and weight distribution of golf clubs placed in the bag 100.

The top cuff 102 may also include a thin-walled flange 162 that extends downward from a rear portion of the top cuff 102. The thin-walled flange 162 has a wall that is thinner than the upper walls of the top cuff 102. For instance, the thin-walled flange 162 may have a 1 mm wall thickness whereas the remainder of the top cuff 102 may have a wall thickness of 2 mm. The thin-walled flange 162 allows for attaching the rear portion of the top cuff 102 to the remainder of the bag 100. The fabric of the bag 100 may cover the thin-walled flange 162 but not the portion of the top cuff 102 above the thin-walled flange 162, which again allows for the leg 108 and/or knuckle 106 to pivot more freely without interference from the fabric.

Figure 16:
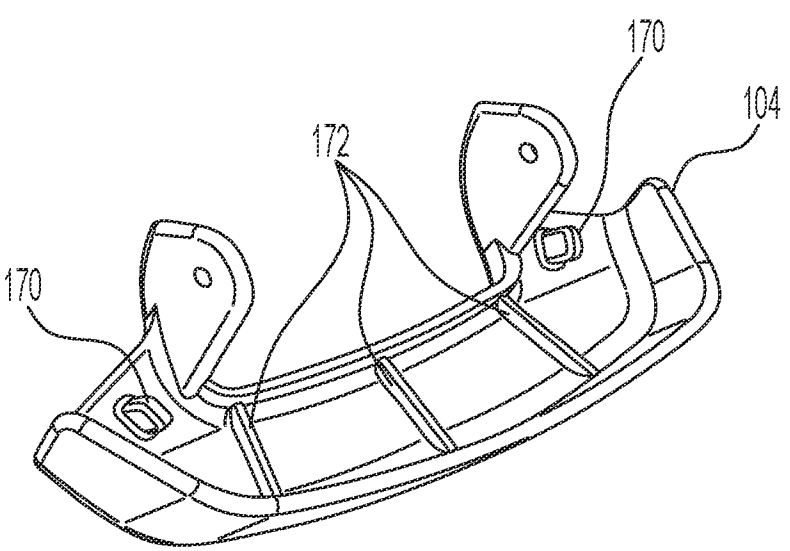
FIG. 16 depicts a perspective view of the underside of an example actuator handle.
Figure 15:
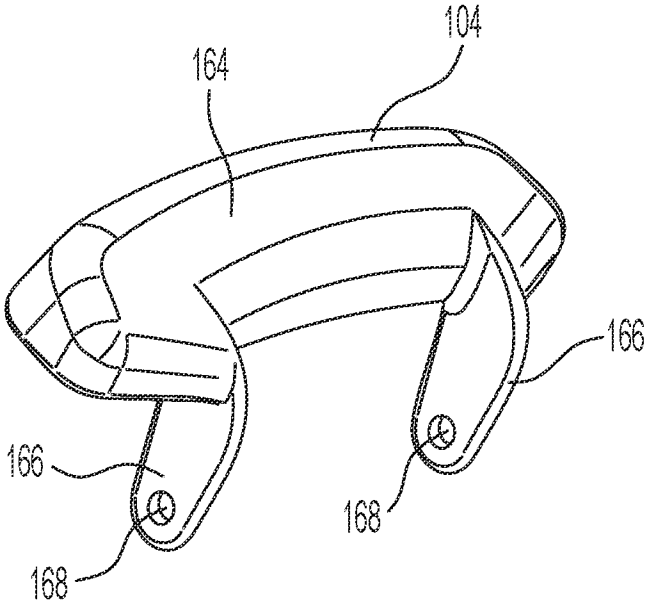
FIG. 15 depicts a perspective view of the top of an example actuator handle.

FIG. 15 depicts a perspective view of the top of an example actuator handle 104. FIG. 16 depicts a perspective view of the underside of the example actuator handle 104. The actuator handle 104 may be molded as single piece or component that is then attached or coupled to the top cuff 102. The actuator handle 104 includes a palm rest 164 and two extensions 166, with each extension having a through hole 168. The palm rest 164 provides a surface for the player's palm when the player is compressing the actuator handle 104. For instance, the players palm is placed on the palm rest 164, and the player's fingers extend downward into the top cuff 102 in front of the palm rest 164. A compressive force is then applied by the player's palm on the palm rest 164 to deploy the legs 108.

To provide better ergonomics as well as to match the contouring the rear of the bag 100, the rear surface is contoured such that it may have a curvature with a center of curvature between the front and the back of the top cuff 102. The front surface of the palm rest 164 between the two extensions 166 is also made wide enough that a player's fingers or hand can easily fit through the opening between the two extensions 166. For instance, the left-to-right distance between the two extensions 166 may be at least 3 inches or between 3.5-5 inches.

The extensions 166 of the actuator handle 104 are coupled to the top cuff 102 via the handle-receiving bosses 156. For instance, the extensions 166 are placed into the groove or the slot of the handle-receiving bosses 156. The extensions 166 are placed into the groove such that the though holes 168 of the extensions 166 are aligned with the though holes 158 in the handle-receiving bosses 156 and recesses 154 of the top cuff 102. Thus, a fastener may be placed through the through holes 158 of the handle-receiving bosses 156 and the through holes 168 of the extensions 166 to couple the actuator handle 104 to the top cuff 102 and allow for rotation of the actuator handle 104 about the fastener.

In some examples, the underside of the actuator handle 104 may also include protruding fingers 170 that align with the knuckles 106 when assembled. The fingers protrude downwardly from the interior surface the actuator handle 104 and may provide additional extensions to help push the knuckles 106 further down resulting in further deployment of the legs 108. Where the fingers 170 are included, the length of the knuckles 106 may be reduced in some examples. Where the fingers 170 are omitted, the length of the knuckles 106 may be extended, or an additional boss protruding from the top of the knuckle 106 may be included.

The walls of the actuator handle 104 may be thicker than the walls of the top cuff 102 in some examples. For instance, the walls of the actuator handle 104 may be about 3 mm as compared to the walls of the top cuff 102 which may be about 2 mm. The additional thickness helps prevent twisting as the player compresses the actuator handle 104 to deploy the legs 108. In addition, ribs 172 may be incorporated on the underside of the actuator handle 104 to also help prevent against twisting. The ribs 172 extend from a rear interior surface of the actuator handle 104 to a front interior surface of the actuator handle 104.

Figure 19:
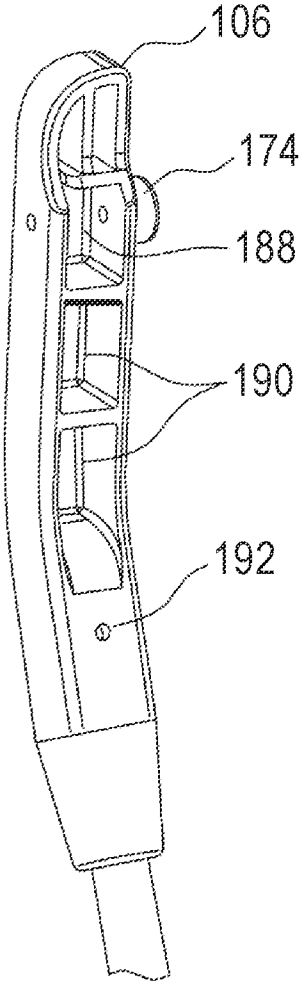
FIG. 19 depicts a perspective back view of the example knuckle.
Figure 18:
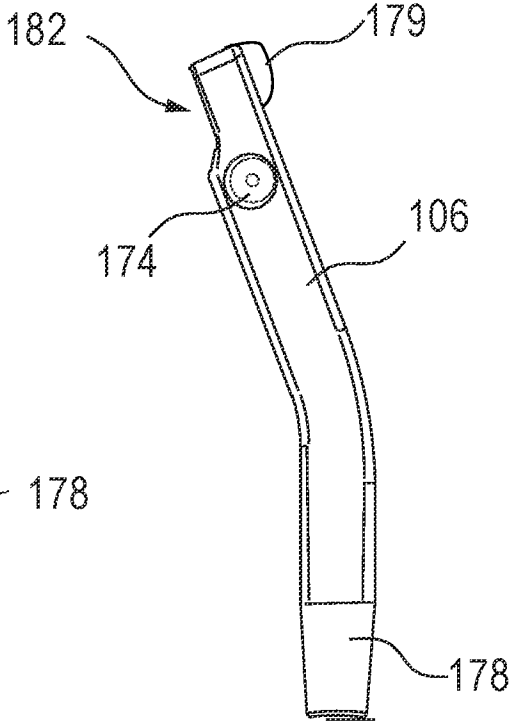
FIG. 18 depicts a side view of an example knuckle.
Figure 17:
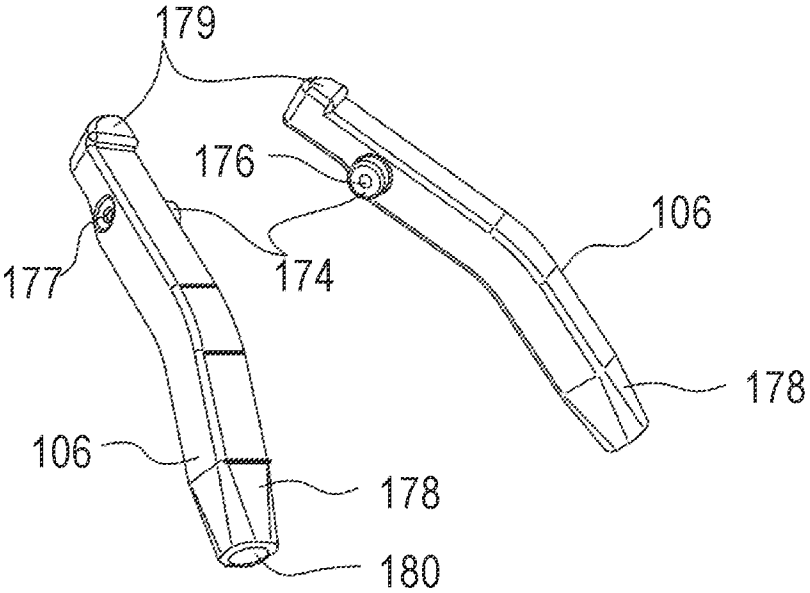
FIG. 17 depicts a perspective view of example knuckles.

FIG. 17 depicts a perspective view of example knuckles 106. FIG. 18 depicts a side view of an example knuckle 106. FIG. 19 depicts a perspective back view of the example knuckle 106. The knuckles 106 include a left knuckle 106 and a right knuckle 106. Each of the knuckles 106 includes an interior knuckle boss 174 that protrudes inwardly from the knuckle 106 (e.g., protrudes towards the interior of the bag 100) and is configured to be received, or at least partially housed, in the recess 154 of the top cuff 102. The interior knuckle boss 174 has a circular cross section to better allow for rotation in the recess 154.

The interior knuckle boss 174 includes a boss through hole 176 that receives the fastener that also passes through the through hole 168 of the actuator handle 104 and the through hole 158 of the top cuff 102. The exterior side of the first knuckle 106 may also include another through hole 177 to allow the fastener to extend all the way through the knuckle 106 in a left-to-right direction.

As shown in FIG. 19, the knuckle 106 also includes a torsion-spring recess 188 that holds at least a coil of the torsion spring. The fastener thus passes through the through hole 176, the center of the coil of the torsion spring, and the through hole 177, which secures the torsion spring in place.

Additional weight-savings cavities 190 may also be incorporated into the knuckle 106. The weight-savings cavities 190 remove excess material from the knuckle 106 to further reduce the overall weight of the bag 100.

The top of the knuckle 174 may also include a protrusion 179. The protrusion 179 may serve a similar purpose as the finger 170 of the actuator handle 104. For instance, the protrusion 179 extends towards the underside of the actuator handle 104 to allow for further deployment of the legs 108 when the actuator handle 104 is compressed.

The lower end of the knuckle 106 includes a leg-receiving portion 178 that receives the leg 108. The leg-receiving portion 178 includes a leg-receiving recess 180 that receives an end of the leg 108. When the leg 108 is inserted into the leg-receiving recess 180, a fastener may be placed though the fixture hole 192 to fix the leg 108 in place.

Figure 20:
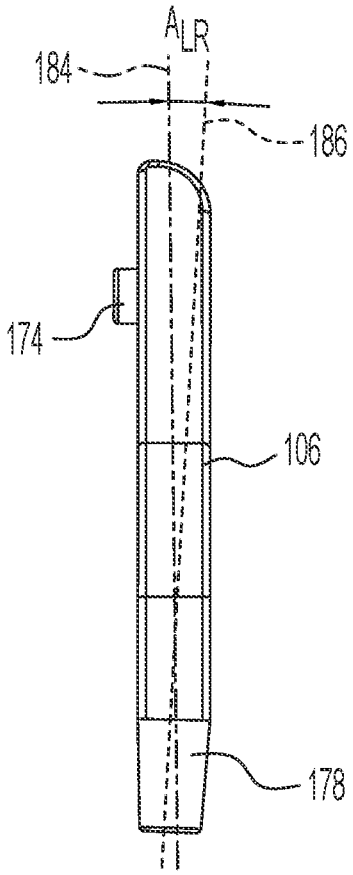
FIG. 20 depicts a front view of the example knuckle.
Figure 21:
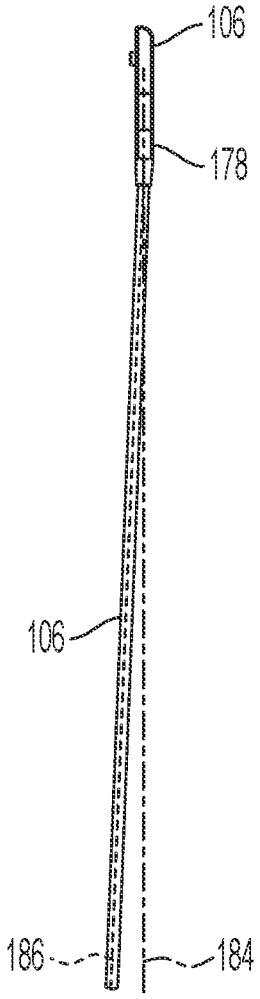
FIG. 21 depicts an example front view of the example knuckle with an attached leg.

FIG. 20 depicts a front view of the example knuckle 106. FIG. 21 depicts a front view of the example knuckle 106 with an attached leg 108. As discussed above, the knuckle 106 includes a leg-receiving portion 178 with a leg-receiving recess 180. The leg-receiving portion 178 and/or the leg-receiving recess 180 may have a different angular orientation from the remainder of the body of the knuckle 106 to help ensure that the leg 108 remains tight to the sides of the bag when in the collapsed state. For instance, the angle of the leg-receiving recess 180 biases the leg 108 towards the inside of the bag 100.

As an example, the remainder of the knuckle body (other than the leg-receiving portion 178) may define an axis from top-to-bottom of the knuckle 106. That axis may be referred to as the knuckle length axis 184. When the knuckle 106 is placed vertically, the knuckle length axis 184 may be a vertical axis or an axis that is perpendicular to the ground plane. The leg-receiving portion 178 and/or the leg-receiving recess 180 define another axis the runs through the center of the leg-receiving recess 180 in a direction aligning with the leg 108. That axis may be referred to as the leg-receiving axis 186.

The angle between the knuckle length axis 184 and the leg-receiving axis 186 may be referred to as the leg retention angle ($A_{LR}$). The leg-retention angle ($A_{LR}$) may be between 2-5 degrees. By having the leg-retention angle ($A_{LR}$) between 2-5 degrees, the legs 108 are better retained on the sides of the bag 100 when collapsed but still provides for an adequate splay width when the legs 108 are in the deployed state.

Figure 24:
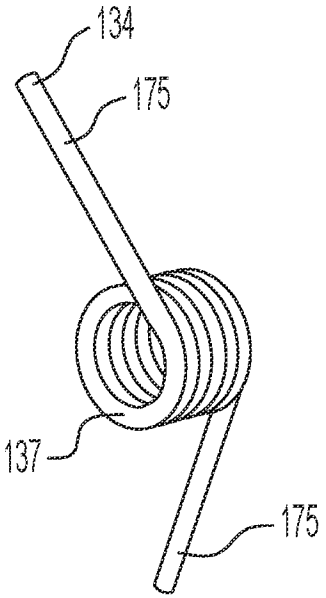
FIG. 24 depicts a perspective view of an example torsion spring.
Figure 23:
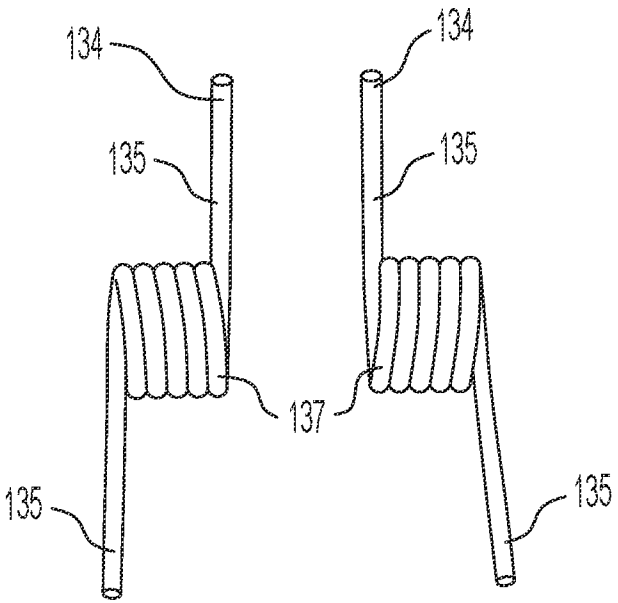
FIG. 23 depicts a front view of example torsion springs.
Figure 22:
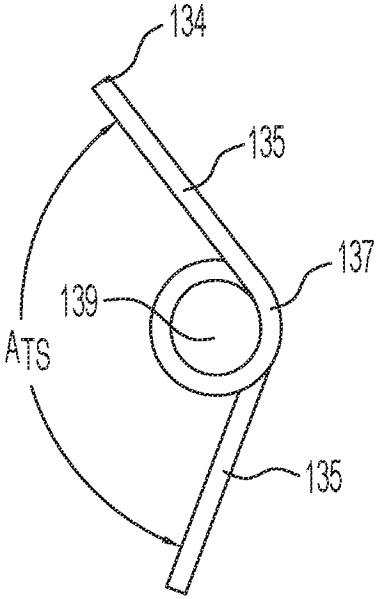
FIG. 22 depicts a side view of an example torsion spring.

FIG. 22 depicts a side view of an example torsion spring 134. FIG. 23 depicts a front view of example torsion springs 134. FIG. 24 depicts a perspective view of an example torsion spring 134. The torsion spring 134 includes a spring coil 137 and two spring legs 135. The center of the coil 137 includes a coil through hole 139.

The angle between the two spring legs 135 is referred to as the torsion spring angle ($A_{TS}$). The torsion spring angle ($A_{TS}$) is the angle between the spring legs 135 when the torsion spring 134 is in its free or unloaded position or state. In some examples, the torsion spring angle ($A_{TS}$) may be between 100-140 degrees, 110-130 degrees, or about 120 degrees. The torsion spring angle ($A_{TS}$) as well as the number of windings and other characteristics may be selected such that the torsion spring retains the legs in the retracted position but also allows for easy compression by the player.

Two different torsion springs 134 may be used in the present golf bag 100. For instance, a left-hand oriented torsion spring 134 and a right-hand oriented torsion spring 134 may be used, as shown in FIG. 23. One of the torsion springs 134 placed in the player-side knuckle 106 and the other torsion spring placed in the non-player-side knuckle 106.

Figure 25:
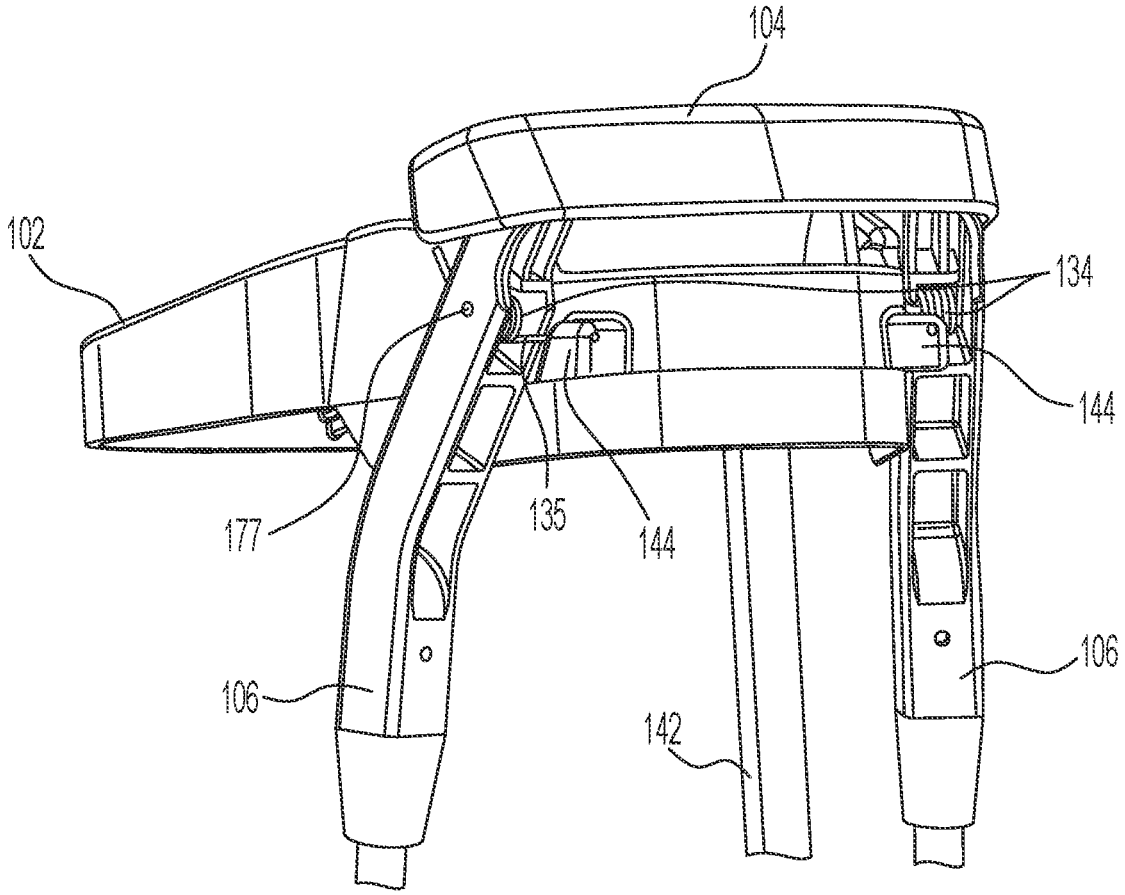
FIG. 25 depicts a perspective view of an example top cuff of the golf bag.

FIG. 25 depicts a perspective view of an example top cuff 102 of the golf bag 100 with the actuator handle 104, knuckles 106, torsion springs 134, and a stay rod 142 coupled to the top cuff 102. The torsion springs 134 are located in the torsion-spring recesses 188 of each of the knuckles 106. One spring leg 135 of the torsion spring 134 is trapped in the knuckle 106 and the other leg 135 of the torsion spring 134 is located in the spring rest 144. The actuator handle 104 is placed in the handle-receiving boss 156. A fastener may then be placed through the through hole 177, the coil through hole 139, the boss through hole 176, and the through hole 158 of the top cuff 158 to secure the components together while still allowing for rotation of the knuckle 106 around or about the fastener.

The bias of the torsion springs 134 causes the knuckle 106 to remain in the retracted or collapsed position until a compression force is applied to the actuator handle 104 by a player's hand. For instance, when the compressive force is applied to the actuator handle 104, the underside of the actuator handle 104 presses on the top of the knuckle 106, which causes the top of knuckle 106 to rotate downward and the bottom or front of the knuckle 106 to rotate upward and/or forward thus deploying the legs 108 to their expanded state. Rotation of the knuckle 106 also applies a force to the torsion spring 134 that causes the torsion spring to no longer be in its unloaded position.

When the knuckle 106 is rotated from its collapsed position, the torsion spring is in a loaded position that applies a force to the knuckle 106 to return the knuckle to the collapsed position. When the bag 100 and the legs 108 are placed on the ground in the expanded state, the friction force from the contact points of the foot 128 and the bottoms of the legs 108 prevents the legs 108 from returning to the collapsed state. When the bag 100 is lifted off the ground, the force from the torsion springs 134 causes the legs 108 to automatically retract to the collapsed position as the torsion springs 134 return to their unloaded position.

Of note, in the example depicted in FIG. 25 includes a single stay rod 142 rather than two stay rods 142 included in the examples above. As compared to using two stay rods 142, the use of a single stay rod 142 further reduces overall weight, but also reduces the stability the bag 100 as the top cuff 102 is more susceptible to twisting relative to the foot 128. When using a single stay rod 142, the cross section of the stay rod 142 may be more rectangular such that the left-to-right length of the stay rod 142 is longer than the front-to-back width of the stay rod 142.

Figure 26:
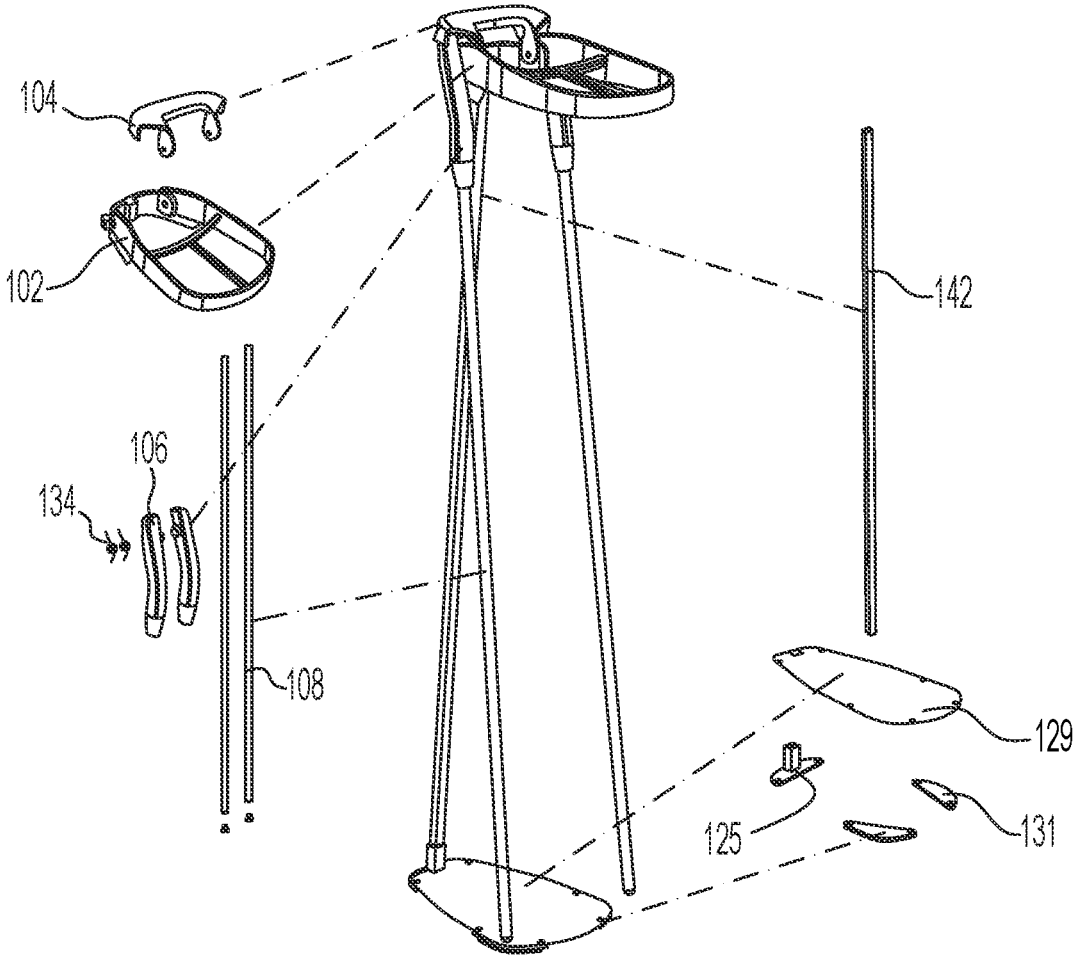
FIG. 26 depicts an exploded view of the skeleton of the golf bag.

FIG. 26 depicts an exploded view of the skeleton of another example golf bag 100. The example golf bag 100 includes many of the same components discussed above, such as a top cuff 102, an actuator handle 104, knuckles 106, legs 108, torsion springs 134, and a stay rod 142. The base of the bag 100 in FIG. 26, however, differs from the other bags 100 described above. The base in bag 100 in FIG. 26 does not utilize the molded foot 128. Rather, the base in FIG. 26 includes board 129 that includes two treads 131 that attach to the underside of the board 129. A stay rod attachment component 125, which may be a protrusion with a recess, may also be attached to the board 129 on a rear side of the board 129. The stay rod attachment component 125 receives the bottom end of the stay rod 142. The board 129 may be made from a polyethylene or other similar material.

Figure 28:
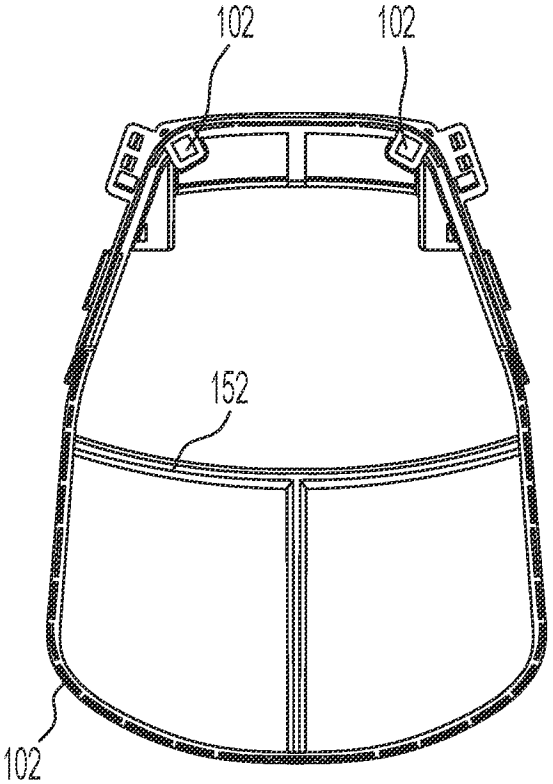
FIG. 28 depicts a bottom view of an example top cuff.
Figure 27:
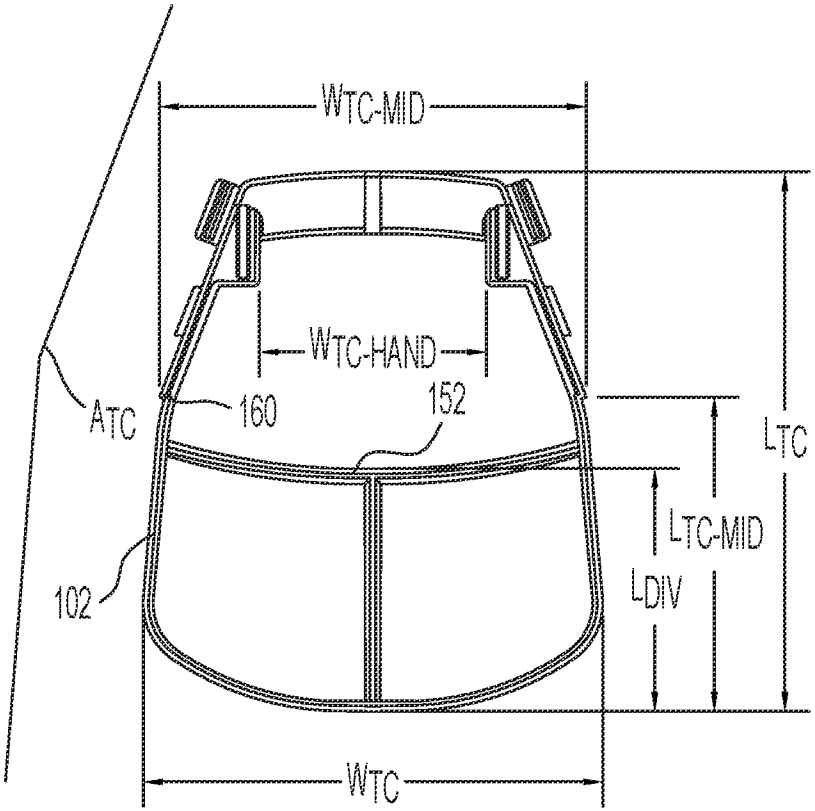
FIG. 27 depicts a top view of an example top cuff.

FIG. 27 depicts a top view of an example top cuff 102. FIG. 28 depicts a bottom view of an example top cuff 102. Example dimensions are depicted for the top cuff 102. A top cuff width ($W_{TC}$) is the largest width (e.g., outside edge of the non-player side to outside edge of the player side) of the top cuff 102 in a left-to-right direction. A top cuff middle width ($W_{TC\text{-}MID}$) may be measured from the outer edge of the player-side surface protrusion 160 to the outer edge of the surface protrusion 160. In top cuff 102 examples that do not include a surface protrusion 160, the top cuff middle width ($W_{TC\text{-}MID}$) may be measured from the outside edges of the top cuff 102 at a middle front-to-back point of the top cuff 102. A top cuff hand width ($W_{TC\text{-}HAND}$) may also be measured between the interior surfaces of the handle-receiving bosses 156 in the left-to-right direction. In examples, where the top cuff 102 does not include handle-receiving bosses 156, the top cuff hand width ($W_{TC\text{-}HAND}$) may be measured from the interior surfaces of the top cuff 102 adjacent to the front edge of the shelf 150 or the position where the player's hand would enter the top cuff 102 when actuating the actuator handle 104. The top cuff hand width ($W_{TC\text{-}HAND}$) may be sized to fit a player's hand or fingers of the player such that the players fingers can reach the underside of the shelf 150 to provide leverage for pressing on the actuator handle.

A length of the top cuff ($L_{TC}$) may is the largest length (e.g., outside edge on a front side to outside edge of the back side) of the top cuff 102 measured in a front-to-back direction. A top cuff middle length ($L_{TC\text{-}MID}$) may be measured from a front surface of the top cuff 102 to the surface protrusion 160 in the front-to-back direction. A top cuff divider length ($L_{DIV}$) may be measured from the front exterior surface of the top cuff 102 to the back surface of the left-to-right crossbar of the three-way divider 152.

In some examples, the top cuff width ($W_{TC}$) may be between 170-180 mm. The top cuff middle width ($W_{TC\text{-}MID}$) may be between 160-180 mm. The top cuff hand width ($W_{TC\text{-}HAND}$) may be at least 75 mm or 100 mm. The top cuff hand width ($W_{TC\text{-}HAND}$) may be between 100-130 mm. The length of the top cuff ($L_{TC}$) may be between 210-230 mm. The top cuff middle length ($L_{TC\text{-}MID}$) may be between 120-140 mm. The top cuff divider length ($L_{DIV}$) may be between 90-110 mm.

A top cuff angle ($A_{TC}$) may be defined by the intersection of planes formed by the rear portion of the top cuff 102 and the front portion of the top cuff 102. For instance, the player side and the non-player side of the rear the top cuff 102 each form planes the extend at an angle that is oblique to the front to-back direction. Those planes may be referred to as the rear side planes of the top cuff 102. The player side and the non-player side of the front of the top cuff 102 each also form planes that the are oblique to the front-to-back direction. Those planes may be referred to as the front side planes of the top cuff 102. The front side planes may be more parallel to the front-to-back direction than the rear side planes. The interior angle between a rear side plane and a front side plane (of the same side, such as the player side) is the top cuff angle ($A_{TC}$). The top cuff angle ($A_{TC}$) may be between 140 degrees to 170 degrees or 155-165 degrees. Such angles allow for the legs 108 to deploy outwardly and away from the player and non-player sides of the bag 100 to form a stable base with a suitable splay width in the expanded state.

Figure 29:
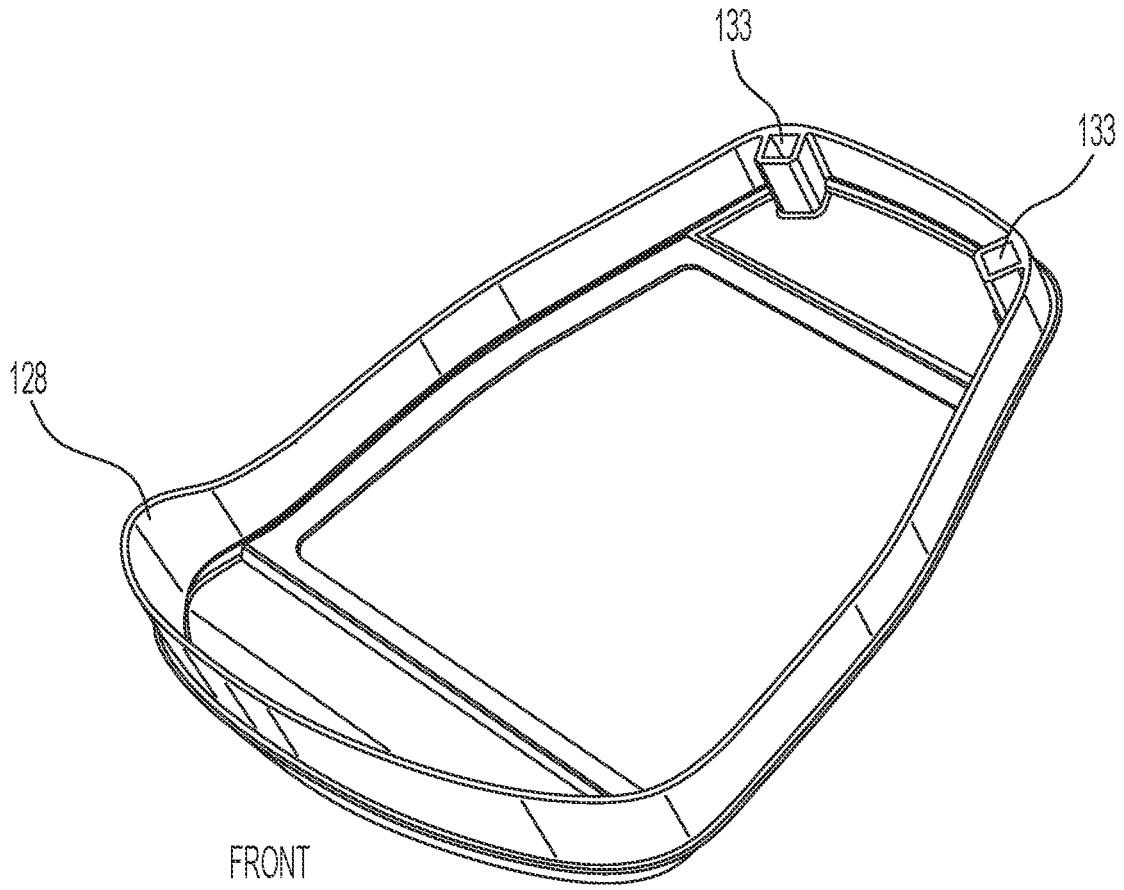
FIG. 29 depicts an example molded foot of a golf bag.
Figure 30:
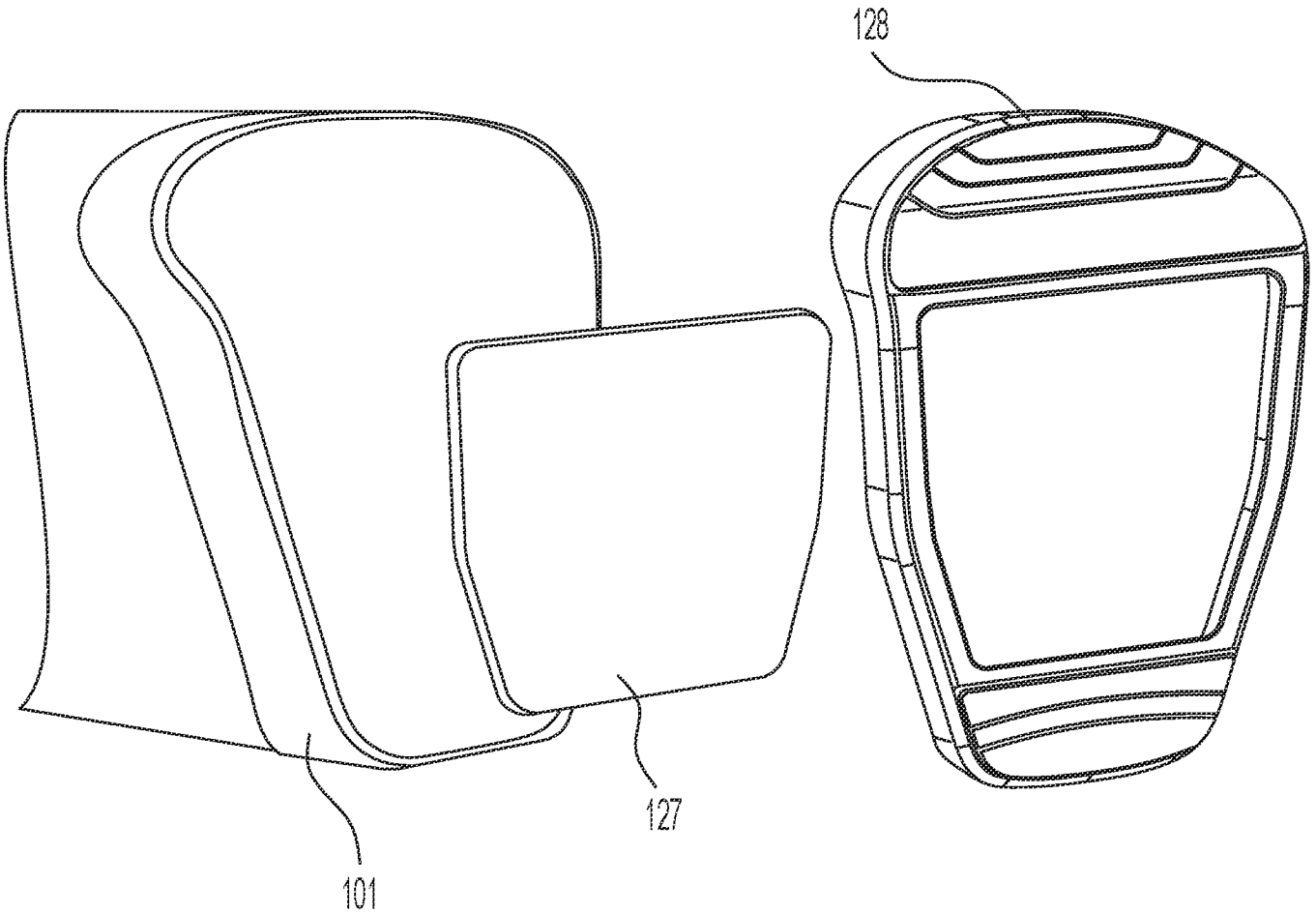
FIG. 30 depicts an exploded view of a bottom portion of an example golf bag.

FIG. 29 depicts an example molded foot 128 of a golf bag 100. FIG. 30 depicts an exploded view of a bottom portion of an example golf bag 100. The molded foot 128 may be injection molded as a single component. The exterior surface of the front portion and the back portion of the foot 128 may include treads or other textures to provide additional gripping ability or friction when the molded foot 128 is placed on the ground. The interior of the foot 128 may include one or more stay-rod receiving recesses 133 that receive any stay rods 142 that are used in the golf bag 100. The perimeter of the foot 128 also includes a flange that extends upwards. The flange may be used to connect the foot 128 to the remainder of the bag 100.

The central portion of the foot 128 may also be open or by unfilled by the molded a foot 128. A board insert 127, such as a PE board, may be inserted or incorporated into the opening of the molded foot 128. The board insert 127 may also be wrapped in fabric. The board insert 127 may be attached to the molded foot 128 using an adhesive, such as a glue. The molded foot 128 with the board insert 127 may then be attached to the bag tube 101.

Figure 31:
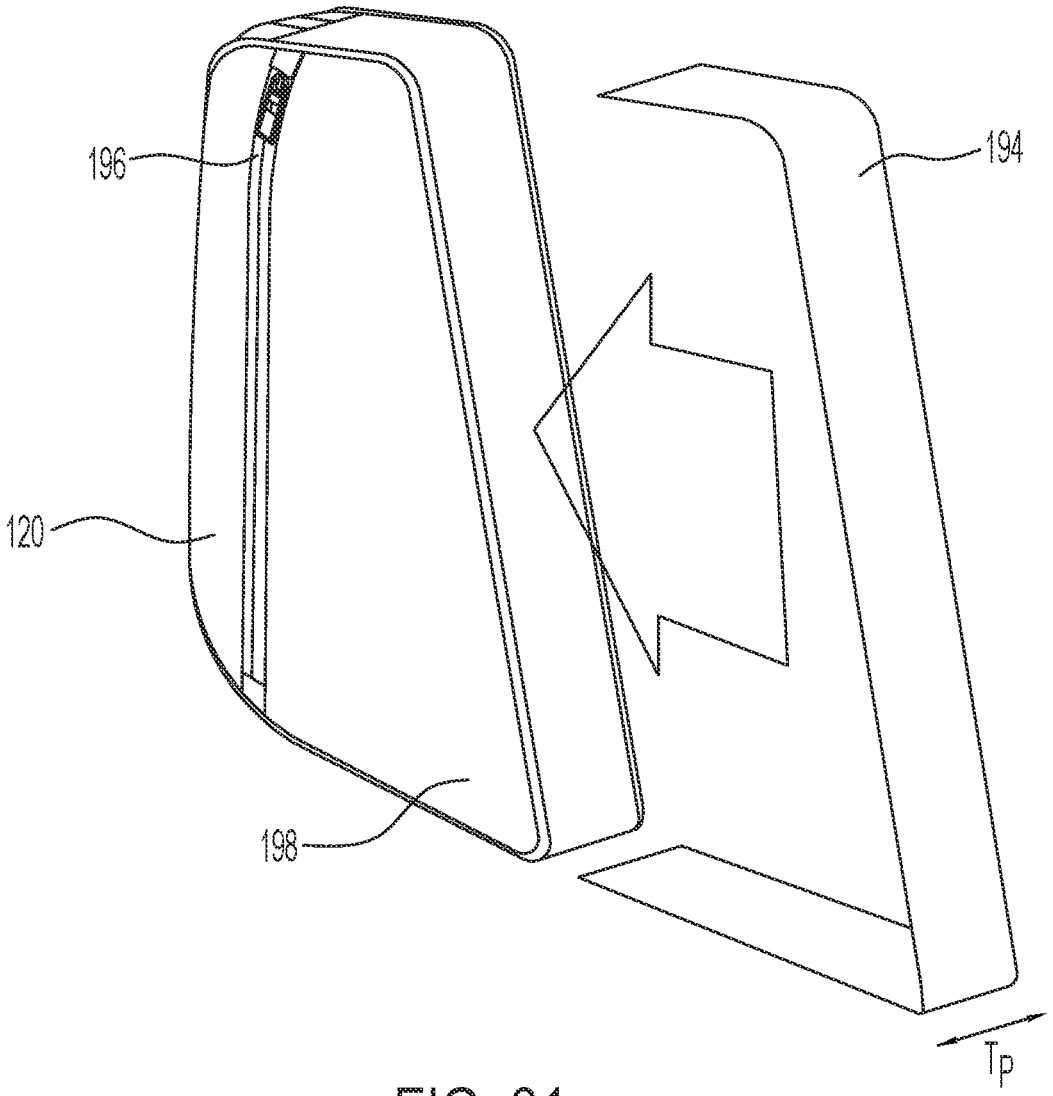
FIG. 31 depicts a perspective view of an example pocket.

FIG. 31 depicts a perspective view of an example structured storage pocket 120. As discussed above, the structured storage pocket 120 may include a zipper 196. The teeth of the zipper 196 may be curved as shown in FIG. 31 to provide easier access into the pocket 120 when the zipper is unzipped. The structured storage pocket 120 includes a backing or structured material that has a stiffness that causes the structured material to retain its shape (rather than collapse like a loose fabric). The structured material may be a PE material, a high-density foam (such as a 4 mm high density foam), and/or an expanded polyethylene (EPE) foam (such as a 5 mm EPE foam). The structured material is incorporated at least on the side of the structured storage pocket 120 that faces a leg 108. In some examples, the structured material is also incorporated on at least a portion of the top side and the bottom side of the structured storage pocket 120 as shown in FIG. 31. For instance, the structured material may wrap around the sides of the pocket 120 from a zipper 196 seam on the bottom side to a zipper 196 seam on the top side of the structured storage pocket 120.

The thickness of the structured portion may also be the thickness of the pocket 120 ($T_P$) as measured from the body of the bag 100 to the exterior surface 198 of the pocket. The thickness of the pocket 120 ($T_P$) is at least as thick as the diameter of a cross section of the leg 108 to help ensure that the structured size of the structured storage pocket 120 provides a landing zone for the leg 108. In some examples, the thickness of the pocket 120 ($T_P$) may be greater than 35 mm, between 35-50 mm, about 45 mm, or greater than or equal to 45 mm.

Figure 32:
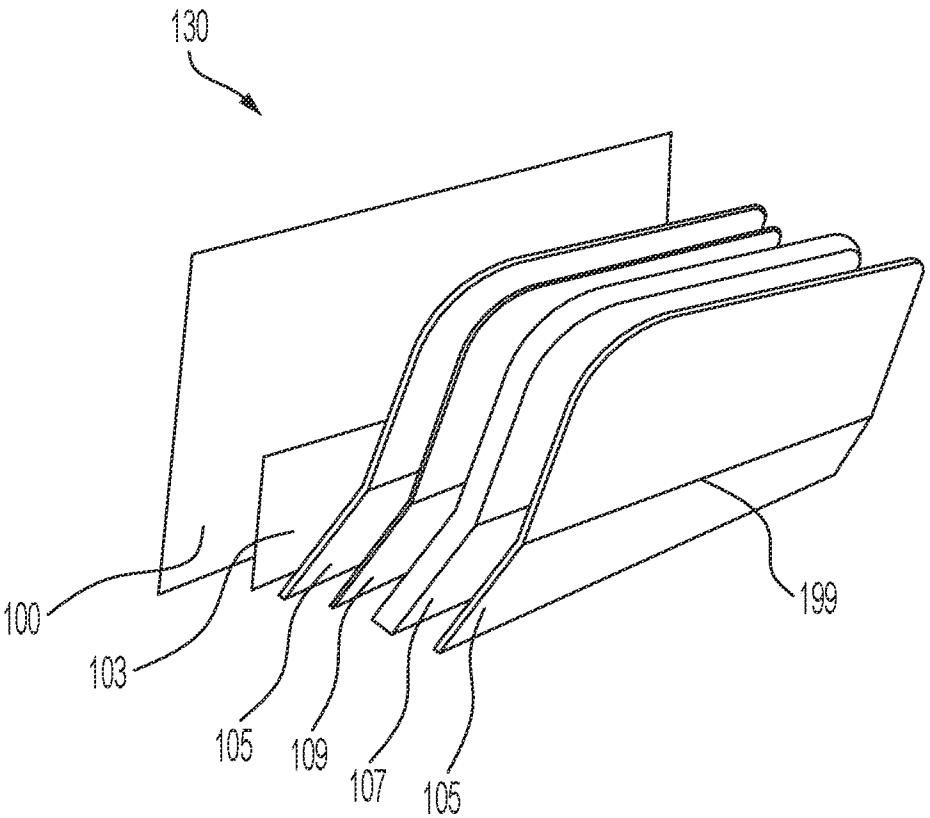
FIG. 32 depicts an exploded view of an example floating hip pad.

FIG. 32 depicts an exploded view of an example floating hip pad 130. The floating hip pad 130 may be made from a plurality of layers of material attached to the sidewall 101 of the bag 100. For instance, a foam wedge spacer 103 may be attached or in contact with the sidewall 101. The spacer 103 provides a landing zone for the leg 108. The maximum thickness of the spacer 103 (e.g., the dimension protruding outward from the sidewall 101) may be greater than a diameter of the leg 108 such that the leg 108 can fit between the remaining layers of the floating hip pad 130 and the sidewall 101. A first fabric panel 105 may then be in contact with the spacer 103. A formed PE board 109 may then be in contact with the first fabric panel 105. The board 109 is more rigid than the fabric panel and provides more structure to the floating hip pad 130. The board 109 may be formed in the desired shape, and the board 109 retains that shape throughout use of the bag 100 or at least when the board 109 is not subjected to an external force (other than gravity), such compression from a player's back or hip. A foam padding 107 may then be attached to the PE board 109. The foam padding 107 provides additional comfort for the player when the floating hip pad 130 is in contact with the player's back or hip. Lastly, a second fabric panel 105 may be attached to the foam padding 107 to protect the foam padding 107.

As can be seen from FIG. 32, each of the layers forming the floating hip pad 130 includes a first portion that protrudes from the sidewall 101 and a second portion that extends more parallel to the sidewall 101 than the first portion. The division between the first portion and the second portion of the floating hip pad 130 may be represented by a dividing line 199 which may be the fold or crease point in the floating hip pad 130.

Figure 33:
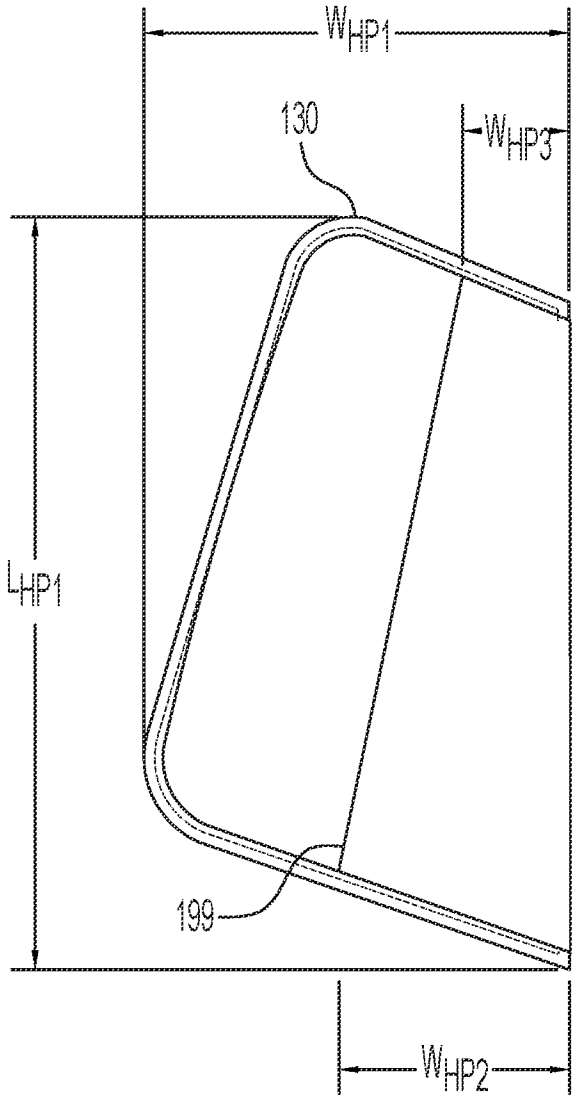
FIG. 33 depicts a left side view of the example floating hip pad.

FIG. 33 depicts a player side view of the example floating hip pad 130. Multiple measurements are provided for the floating hip pad 130. The length of the floating hip pad 130 ($L_{HP1}$) may be measured from the lowest point of the floating hip pad 130 to the highest point of the floating hip pad 130 measured along a top-to-bottom direction of the bag 100, which may be the vertical direction or a direction orthogonal to the ground plane when the bag is placed in an upright position on the ground. A first width of the floating hip pad 130 ($W_{HP1}$) is measured from the frontmost point of the floating hip pad 130 to the rearmost point of the floating hip pad 130 (which may be the connection point of the floating hip pad 130 to the body of the bag 100). A second width of the floating hip pad 130 ($W_{HP2}$) may be measured from the frontmost point of the dividing line 199 to the rearmost point of the floating hip pad 130. A third width of the floating hip pad 130 ($W_{HP3}$) may be measured from the rearmost point of the dividing line 199 to the rearmost point of the floating hip pad 130.

In some examples, the length of the floating hip pad 130 ($L_{HP1}$) may be between 220-260 mm or 230-240 mm. The first width of the floating hip pad 130 ($W_{HP1}$) may be between 120-140 mm or 125-145 mm. The second width of the floating hip pad 130 ($W_{HP2}$) may be between 50-80 mm or 60-70 mm. The third width of the floating hip pad 130 ($W_{HP3}$) may be between 25-45 mm or 35-40 mm. The relationship between the widths and distances have an effect on how the floating hip pad 130 is able to protect the player from contact with the leg. For instance, the lengths and widths may be configured such that the dividing line 199 is substantially parallel with the ground plane when the bag 100 is worn by a player. The front surface and/or the dividing line 199 may be parallel with the leg 108 and/or extend at an angle that is substantially the same as the leg angle ($A_{LEG}$).

Figure 34:
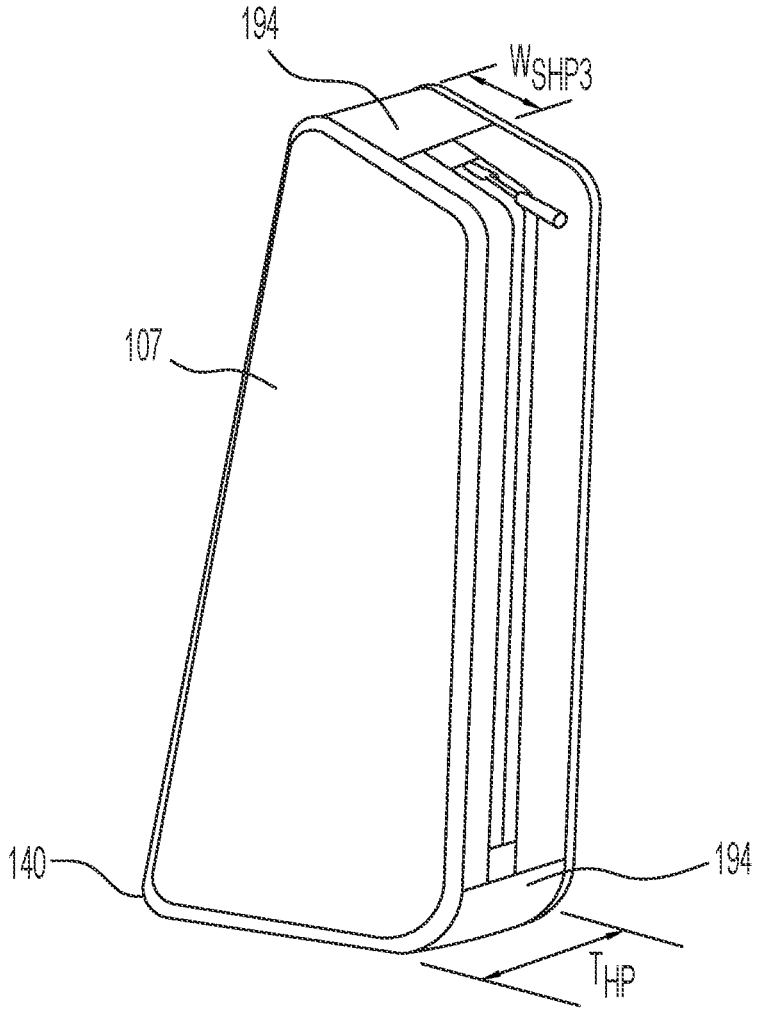
FIG. 34 depicts a perspective view of an example pocket hip pad.
Figure 35:
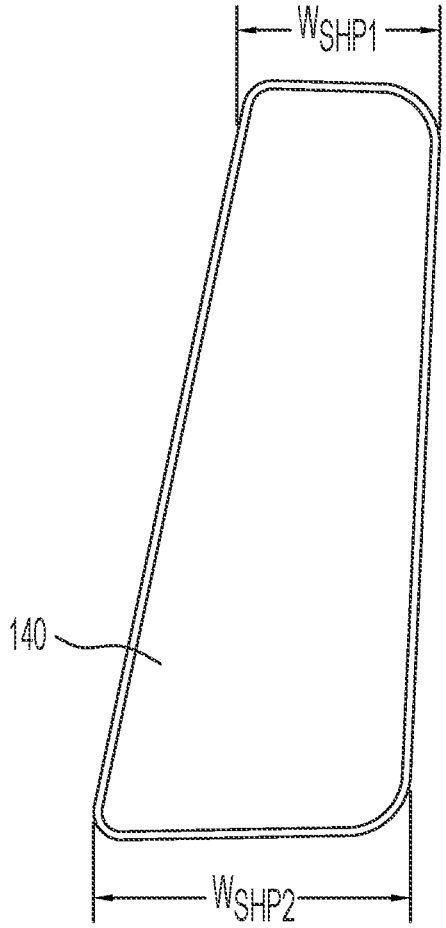
FIG. 35 depicts a left side view of the example pocket hip pad.
Figure 36:
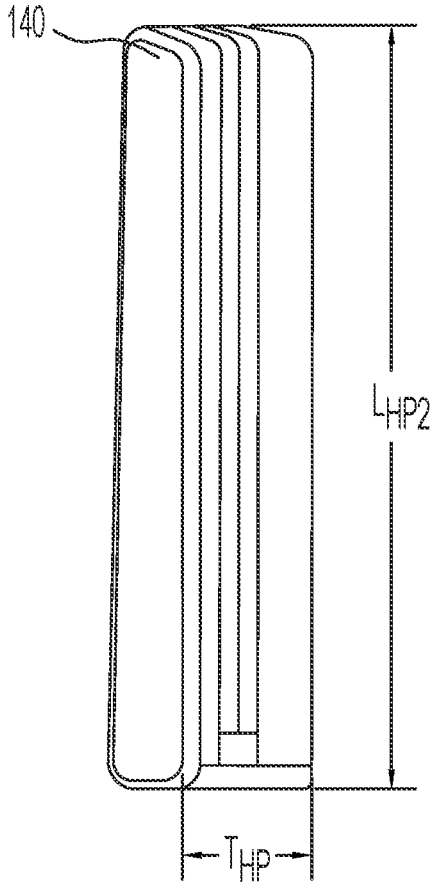
FIG. 36 depicts a back view of the example pocket hip pad.

FIG. 34 depicts a perspective view of an example structured-pocket hip pad 140. FIG. 35 depicts a left side view of the example pocket hip pad 140. FIG. 36 depicts a back view of the example pocket hip pad 140. The structured-pocket hip pad 140 may have some similar features as the structured storage pocket 120 discussed above. For instance, the side of the structured-pocket hip pad 140 that faces or contacts the leg (e.g., the front side) is a structured side made from a structured, backing, or reinforcement material 194 that has enough rigidity to retain its shape when the bag 100 is worn by the player, unlike a fabric. Thus, the player-side surface of the structured-pocket hip pad 140 is offset from, or stands off of, the outer wall of the bag 100.

The reinforcement material 194 may form the front side of the structured-pocket hip pad 140 as well as at least a portion of other sides of the structured-pocket hip pad 140. For instance, in the example depicted in FIG. 34, the reinforcement material 194 forms the bottom side and a portion of the top side of the structured-pocket hip pad 140. In examples where the structured-pocket hip pad 140 includes a zipper, the reinforcement material 194 may begin at one end of the zipper and end at the other end of the zipper, as shown in the example structured-pocket hip pad 140 of FIG. 34.

The amount that the player-side surface is offset is the thickness of the hip pad 140 ($T_{HP}$). The thickness of the hip pad 140 ($T_{HP}$) is at least as thick as the diameter of a cross section of the leg 108 to help ensure that the structured size of the structured-pocket hip pad 140 provides a landing zone for the leg 108 while still preventing the leg 108 from contacting the player's back or hip. In some examples, the thickness of the hip pad 140 ($T_{HP}$) may be greater than 35 mm, between 35-50 mm, about 45 mm, or greater than or equal to 45 mm. The player-side surface of the structured-pocket hip pad 140 may also include a foam padding 107 that may be covered by another fabric. The foam padding 107 provides additional comfort to the player when the structured-pocket hip pad 140 is in contact with the body of the player. The front surface of the structured-pocket hip pad 140 may be parallel with the leg 108 and/or extend at an angle that is substantially the same as the leg angle ($A_{LEG}$).

A width of the top side ($W_{SHP1}$) of the structured-pocket hip pad 140 may be measured from the frontmost edge of the top side to a rearmost edge of the top side as measured along the front-to-back direction. The width of the top side ($W_{SHP1}$) may be between 60-80 mm. A width of the bottom side ($W_{SHP2}$) of the structured-pocket hip pad 140 may be measured from the frontmost edge of the bottom side to the rearmost edge of the bottom side as measured along the front-to-back direction. The width of the bottom side ($W_{SHP2}$) may be between 105-125 mm. The ratio of the width of the bottom side ($W_{SHP1}$) to the width of the top side ($W_{SHP2}$) may be between 1.3:1 to 2:1 or about 1:6.

The reinforcement material 194 may form a portion of width of the top side ($W_{SHP3}$) of the structured-pocket hip pad 140. The reinforcement material width on the top side ($W_{SHP3}$) may be between ¼ to ½ the full width of the top side ($W_{SHP1}$). For instance, the reinforcement material width on the top side ($W_{SHP3}$) may be between 25-35 mm. By incorporating the reinforcement material 194 on at least a portion of the top side and/or bottom side of the structured-pocket hip pad 140, the structure of the structured-pocket hip pad 140 is further reinforced, which improves the overall durability of the golf bag 100.

Figure 40:
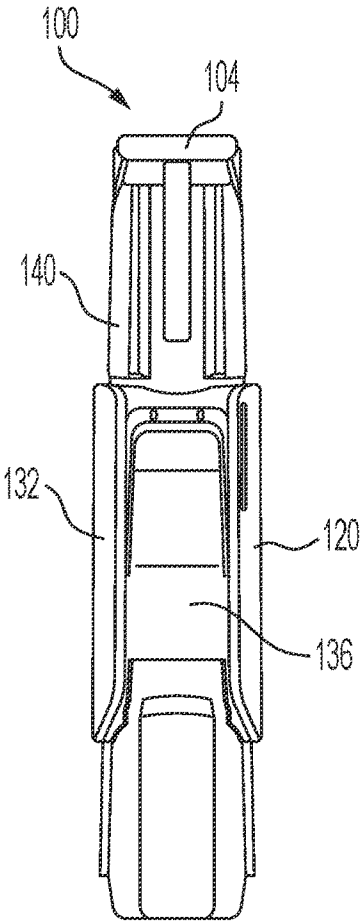
FIG. 40 depicts a back view of the example golf bag of FIG. 38.
Figure 39:
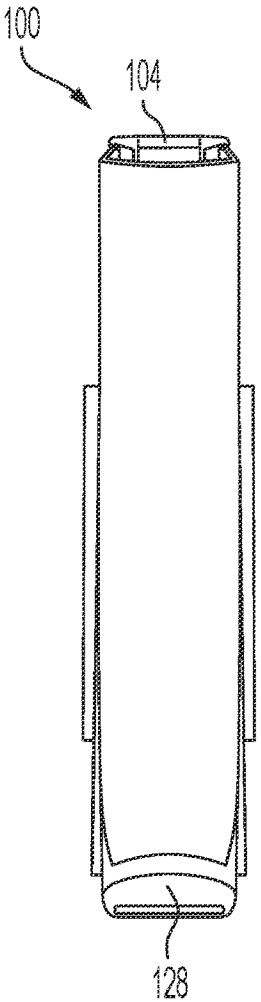
FIG. 39 depicts a front side view of the example golf bag of FIG. 38.
Figure 38:
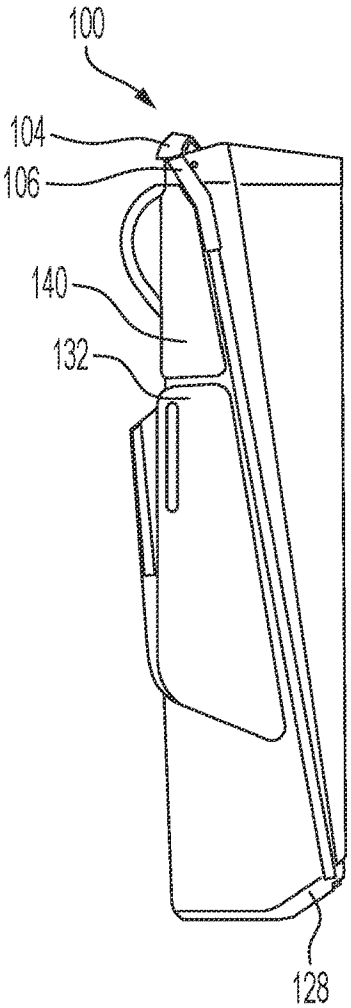
FIG. 38 depicts a left side view of the example golf bag of FIG. 38.
Figure 37:
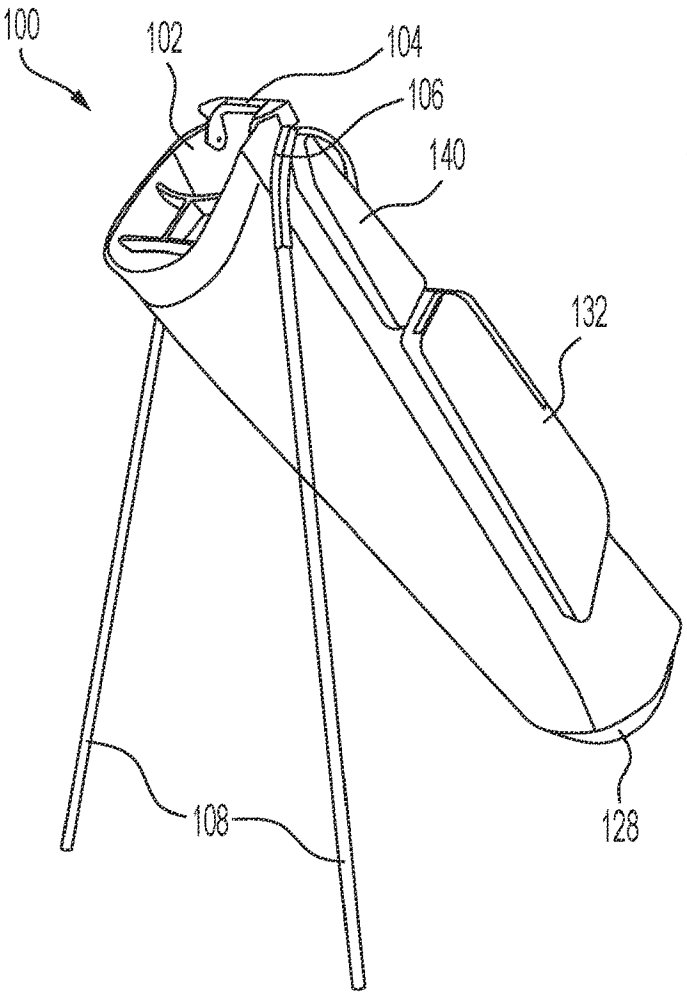
FIG. 37 depicts a perspective view of another example golf bag.

FIG. 37 depicts a perspective view of another example golf bag 100. FIG. 38 depicts a player side view of the example golf bag 100. FIG. 39 depicts a front side view of the example golf bag 100. FIG. 40 depicts a back view of the example golf bag 100. The bag 100 includes many of the same components as discussed with the examples golf bags 100 discussed above. For example, the example golf bag 100, includes a top cuff 102, a top cuff 102, knuckles 106, legs 108, a player-side structured pocket 132, and a structured storage pocket 120, a zippered pocket 136, and a molded foot 128, among other components. The example bag 100 in FIGS. 37-40 differ from the example bags discussed above in that the player-side structured pocket 132, structured storage pocket 120, and the zippered pocket 136 are located at a higher position on the golf bag 100. By moving the position of those pockets higher on the bag 100, a player can more easily access the pockets when the bag 100 is on the ground in the expanded state. For example, some players may have difficulty bending down to access or reach items that are close to the ground. By moving the pockets upwards on the bag, the player need not bend or reach as far towards the ground to access the items in the pockets. The lower edge or boundary of the player-side structured pocket 132, structured storage pocket 120, and/or the zippered pocket 136 may be located at least 8, 10, or 12 inches from the bottom surface of the foot 128 as measured in a top-to-bottom direction.

Figure 42:
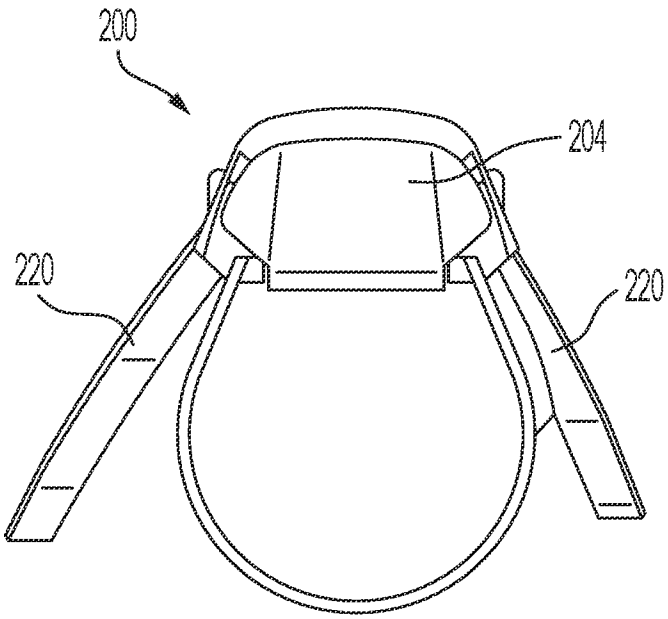
FIG. 42 depicts a top view of the example golf bag of FIG. 41.
Figure 41:
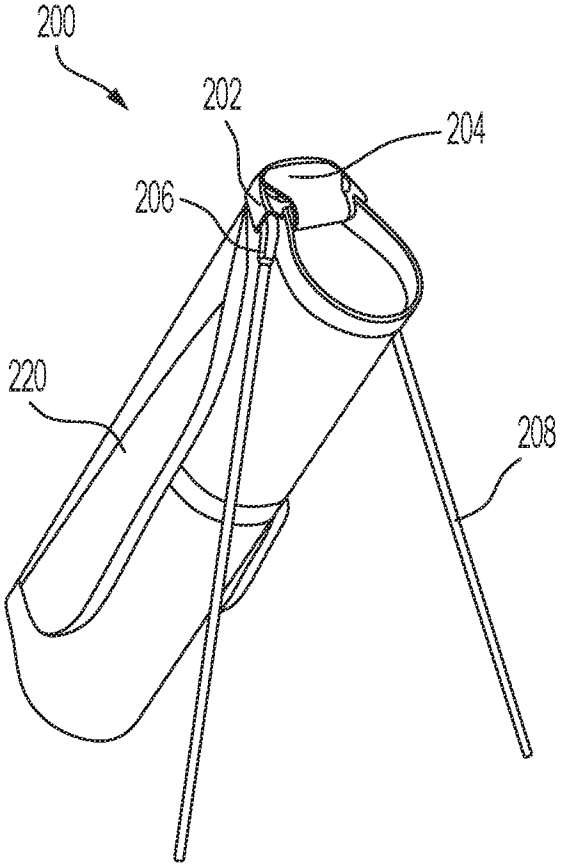
FIG. 41 depicts a perspective view of another example golf bag.

FIG. 41 depicts a perspective view of another example golf bag 200. FIG. 42 depicts a top view of the example golf bag 200. Similar to the golf bags discussed above, the example golf bag 200 includes a top cuff 202, an actuator handle 204, knuckles 206, legs 208, and pockets 220. The actuator handle 204 differs from the actuator handle 104 discussed above in that the actuator handle 204 does not include the extensions discussed above. Rather, the actuator handle 204 has an extended, curved front portion that wraps around a shaft of the top cuff 202. The principle of operation, however, is substantially the same. For instance, as the actuator handle 204 rotates around the shaft, the bottom surface of the actuator handle 204 contacts the top portion of the knuckles 106, which causes the knuckles 106. Rotation of the knuckles 106 causes the legs 208 to deploy into the expanded state.

The example golf bag 200 also differs from the golf bag 100 above in that the golf bag 200 includes different pockets 220. The pockets 220 have a significantly longer length. For instance, the length of the pockets may be at least ⅔ or ¾ of the length of the golf bag 200. In addition, the pockets 220 also overlap the legs 208. Because the pockets 220 overlap the legs 108, the pockets 220 are also floating or stood off from the sides of the body golf bag 200 to avoid interfering with the legs 208. Standing the pockets 220 off from the outer sides of the body of the golf bag 200 may be accomplished in a variety of manners, including the techniques used to stand the second portion of the floating hip pad 130 off of the bag 100 discussed above. For example, structured materials and/or a wedge or spacer may be used to stand the pockets 220 off form the sides of the body of the bag 200. More specifically, a spacer or wedge may be placed between the pocket 220 and the exterior side of the body of the bag 200. The side of the pocket 220 and/or the exterior-facing side of the pocket 220 may also may also be partially formed from a structured material such that the pocket 220 further extends outward from the body of the bag 200.

Figure 44:
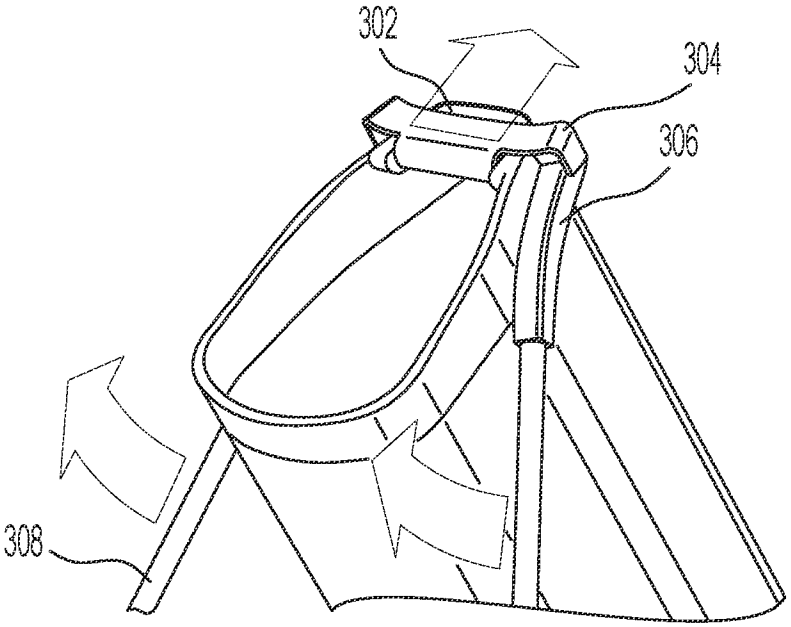
FIG. 44 depicts a perspective view of the example golf bag of FIG. 43 in the expanded state.
Figure 43:
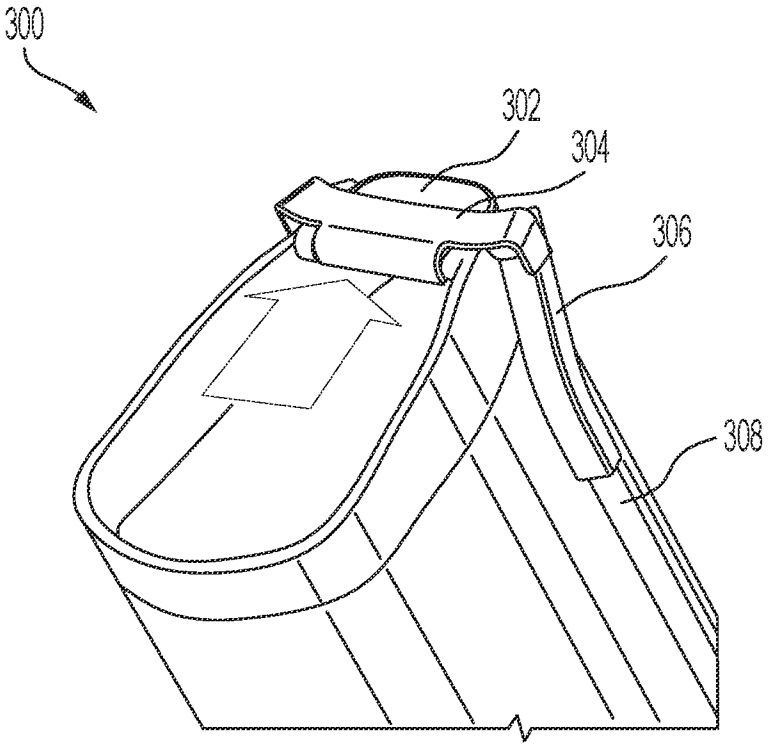
FIG. 43 depicts a perspective view of another example golf bag in the collapsed state.

FIG. 43 depicts a perspective view of another example golf bag 300 in the collapsed state. FIG. 44 depicts a perspective view of the example golf bag 300 in the expanded state. The golf bag 300 includes a top cuff 302, an actuator handle 304, knuckles 306, and legs 308. The actuator handle 304 has some similarities to the actuator handle 204 and the actuator handle 104 above, but the actuator handle 304 causes deployment of the legs 308 in a different manner.

Rather than rotating around an axis, the actuator handle 304 slides in a front-to-back direction. As the actuator handle 304 slides backwards, the actuator handle contacts the knuckles 306, causing the knuckles 306 to pivot or rotate. The rotation of the knuckles 306 cause the legs 308 to deploy into the expanded state, as shown in FIG. 44. The sliding of the actuator handle 304 may be caused a squeezing of the actuator handle 304 toward to the back of the top cuff 302 by a player's hand. As such, the actuator handle 304 may be referred to as a squeeze-actuated actuator handle 304 or a slide-activated actuator handle 304. The actuator handle 304 may slide over a shelf of the top cuff 302 positioned in the rear of the top cuff 302. Of note, the knuckles 306 may still incorporate or house torsion springs that operate in substantially the same manner as discussed above. For instance, when actuator handle 304 rotates the knuckles 306, a load is placed on the torsion spring that is biased to the collapsed position. When the bag 300 is then picked up from its expanded state (and/or the squeeze force on the actuator handle 304) is released, the torsion springs cause the knuckles 106 to rotate back to the collapsed state.

Although specific devices have been recited throughout the disclosure as performing specific functions, one of skill in the art will appreciate that these devices are provided for illustrative purposes, and other devices may be employed to perform the functionality disclosed herein without departing from the scope of the disclosure. This disclosure describes some embodiments of the present technology with reference to the accompanying drawings, in which only some of the possible embodiments were shown. Other aspects may, however, be embodied in many different forms and should not be construed as limited to the embodiments set forth herein. Rather, these embodiments were provided so that this disclosure was thorough and complete and fully conveyed the scope of the possible embodiments to those skilled in the art. Further, as used herein and in the claims, the phrase "at least one of element A, element B, or element C" is intended to convey any of: element A, element B, element C, elements A and B, elements A and C, elements B and C, and elements A, B, and C. Further, one having skill in the art will understand the degree to which terms such as "about" or "substantially" convey in light of the measurement techniques utilized herein. To the extent such terms may not be clearly defined or understood by one having skill in the art, the term "about" shall mean plus or minus ten percent.

Although specific embodiments are described herein, the scope of the technology is not limited to those specific embodiments. Moreover, while different examples and embodiments may be described separately, such embodiments and examples may be combined with one another in implementing the technology described herein. One skilled in the art will recognize other embodiments or improvements that are within the scope and spirit of the present technology. Therefore, the specific structure, acts, or media are disclosed only as illustrative embodiments. The scope of the technology is defined by the following claims and any equivalents therein.

What is claimed is:

1. A golf bag comprising:

a top cuff comprising:

a circular recess in an exterior surface of the top cuff, the circular recess including a through hole, a first handle-receiving boss protruding inward from an interior surface of the top cuff; and a second handle-receiving boss protruding inward from the interior surface of the top cuff, wherein a top cuff hand width ($W_{TC\text{-}HAND}$) is measured from an interior surface of the first handle-receiving boss to an interior surface of the second handle-receiving boss and the top cuff hand width ($W_{TC\text{-}HAND}$) is greater than 75 mm;

a knuckle comprising:

an interior knuckle boss at least partially housed inside the circular recess of the top cuff, the knuckle boss including a through hole aligned with the through hole of the circular recess of the top cuff; and a leg-receiving portion;

a leg connected to the leg receiving portion of the knuckle; and an actuator handle coupled to the top cuff and in contact with the knuckle, wherein downward pressure applied to the actuator handle causes an underside of the actuator handle to press on a top of the knuckle to rotate the knuckle, wherein rotation of the knuckle causes the leg to deploy into an expanded state.

2. The golf bag of claim 1, wherein:

the first handle-receiving boss includes a slot; and the actuator has an extension with a through hole, wherein the extension is positioned in the slot of the first handle-receiving boss.

3. The golf bag of claim 1, wherein the knuckle defines a knuckle length axis, the leg-receiving portion defines a leg-receiving axis, and a leg retention angle is formed between the knuckle length axis and the leg-receiving axis, wherein the leg-receiving portion biases the leg towards an interior of the golf bag.

4. The golf bag of claim 3, wherein the leg retention angle is between 2 and 5 degrees.

5. The golf bag of claim 1, further comprising a molded foot having an angled front portion, wherein the angled front portion has a foot angle ($A_F$) between 30-50 degrees.

6. The golf bag of claim 1, further comprising a floating hip pad, wherein the floating hip includes a first portion protruding outwardly from a body of the golf bag and a second portion extending substantially parallel to the body of the golf bag, wherein the second portion covers a portion of the leg when the leg is in a collapsed position.

7. The golf bag of claim 1, further comprising a structured-pocket hip pad comprising a structured leg-facing side to stand the exterior surface of the structured-pocket hip pad off of a body of the golf bag by a distance greater than a thickness of the leg.

8. The golf bag of claim 1, wherein:

the top cuff is a single molded component;

the actuator handle is coupled to a back side of the top cuff;

the interior knuckle boss protrudes inwardly towards an inside of the golf bag;

the downward pressure is from a user of the golf bag; and the underside of the actuator handle includes protruding fingers aligned with back portions of the knuckles such that the protruding fingers contact the knuckles when the downward pressure is applied to the actuator handle.

9. A golf bag comprising:

a top cuff having a front side, a back side, a player side, and a non-player side, the top cuff comprising:

a first circular recess on the player side, the first circular recess including a through hole; and a second circular recess on the non-player side, the second circular recess including a through hole;

a first knuckle comprising:

a first interior knuckle boss at least partially housed inside the first circular recess of the top cuff, the first knuckle boss including a through hole aligned with the through hole of the first circular recess; and a first leg-receiving portion;

a second knuckle comprising:

a second interior knuckle boss at least partially housed inside the second circular recess, the second knuckle boss including a through hole aligned with the through hole of the second circular recess;

a second leg-receiving portion;

a first handle-receiving boss protruding inward from an interior surface of the player side, the first handle-receiving boss including a first slot;

a second handle-receiving boss protruding inward from an interior surface of the non-player side, the second handle-receiving boss including a second slot;

a first leg connected to the first leg receiving portion of the first knuckle;

a second leg connected to the second leg receiving portion of the second knuckle;

an actuator handle coupled to the top cuff and in contact with the first knuckle and the second knuckle, wherein downward pressure applied to the actuator handle causes an underside of the actuator handle to press on a top of the first knuckle and the second knuckle to rotate the first knuckle and rotate the second knuckle, wherein rotation of the first knuckle and the second knuckle cause the first leg and the second leg to deploy into an expanded state, wherein the actuator handle comprises:

a first extension with a through hole, wherein the first extension is positioned in the first slot of the first handle-receiving boss; and a second extension with a through hole, wherein the second extension is positioned in the second slot of the second handle-receiving boss;

a first stay rod connected to the top cuff, and a molded foot connected to the stay rod.

10. The golf bag of claim 9, further comprising a second stay rod connected to the top cuff and the molded foot, wherein the second stay rod has a non-circular cross section.

11. The golf bag of claim 9, wherein the top cuff further comprises:

a first spring rest on an exterior of the player side;

a second spring rest on an exterior of the non-player side; and the golf bag further comprises:

a first torsion spring having a first coil and two spring legs, wherein the first coil and one of the spring legs of the first torsion spring is at least partially housed within the first knuckle and the other spring leg is at least partially housed within the first spring rest; and a second torsion spring having a second coil two spring legs, wherein the second coil and one of the spring legs of the second torsion spring is at least partially housed within the second knuckle and the other spring leg is at least partially housed within the second spring rest.

12. The golf bag of claim 9, wherein the foot is a molded foot having an angled front portion, wherein the angled front portion has a foot angle ($A_F$) between 30-50 degrees.

13. The golf bag of claim 9, further comprising a floating hip pad, wherein the floating hip includes a first portion protruding outwardly from a body of the golf bag and a second portion extending substantially parallel to the body of the golf bag, wherein the second portion covers at least a portion of first leg.

14. The golf bag of claim 9, further comprising a structured-pocket hip pad comprising a structured leg-facing side to stand an exterior surface of the structured-pocket hip pad off of a body of the golf bag by a distance greater than a thickness of the first leg.

15. The golf bag of claim 9, wherein the first knuckle defines a knuckle length axis, the first leg-receiving portion defines a leg-receiving axis, and a leg retention angle is formed between the knuckle length axis and the leg-receiving axis, wherein the leg-receiving axis biases the first leg towards an interior of the golf bag.

16. The golf bag of claim 9, wherein the top cuff further comprises a shelf extending from the back side of the top cuff, wherein a top surface of the shelf provides a stop for the actuator handle when that actuator handle is rotated, and an underside of the shelf provides a position for a player's fingers to be placed when pressing the actuator handle to deploy the legs.

17. A golf bag comprising:

a top cuff comprising:

a circular recess in an exterior surface;

a first handle-receiving boss protruding inward from an interior surface of the top cuff; and a second handle-receiving boss protruding inward from the interior surface of the top cuff, wherein a top cuff hand width ($W_{TC\text{-}HAND}$) is measured from an interior surface of the first handle-receiving boss to an interior surface of the second handle-receiving boss and the top cuff hand width ($W_{TC\text{-}HAND}$) is greater than 75 mm;

a knuckle comprising:

an interior knuckle boss at least partially housed inside the recess; and a leg-receiving portion;

a leg connected to the leg receiving portion of the knuckle, wherein the leg extends at a leg angle ($A_{LEG}$) between 10-25 degrees;

an actuator handle coupled to the top cuff and in contact with the knuckle, wherein downward pressure applied to the actuator handle causes an underside of the actuator handle to press on a top of the knuckle to cause the knuckle to rotate, wherein rotation of the knuckle causes the leg to deploy into an expanded state from a collapsed state; and at least one of:

a floating hip pad, wherein the floating hip includes a first portion protruding outwardly from a body of the golf bag and a second portion extending substantially parallel to the body of the golf bag, wherein the second portion covers at least a portion of the leg when the leg is in the collapsed position; or a structured-pocket hip pad comprising a structured leg-facing side to stand the exterior surface of the structured-pocket hip pad off of a body of the golf bag by a distance greater than a thickness of the leg.

18. The golf bag of claim 17, wherein the floating hip pad further comprises a wedge spacer.

* * * * *